US005960576A

United States Patent [19]

Robinson

[11] Patent Number: 5,960,576

[45] Date of Patent: Oct. 5, 1999

[54] RANGE, BULLET DROP, AND ANGLE CALCULATOR FOR USE WITH TELESCOPIC GUN SIGHTS

[76] Inventor: Bruce N. Robinson, P.O. Box 1535, Los Lunas, N.Mex. 87031

[21] Appl. No.: 09/146,585

[22] Filed: Sep. 3, 1998

Related U.S. Application Data

[63] Continuation-in-part of application No. 09/018,498, Feb. 4, 1998.

[51] Int. Cl.[6] ..... F41A 15/00

[52] U.S. Cl. ..... 42/90; 42/101

[58] Field of Search ..... 42/90, 101; 33/245, 33/298, 246

[56] References Cited

U.S. PATENT DOCUMENTS

| | | | |
|---|---|---|---|
| 2,094,623 | 10/1937 | Stokey | 33/50 |
| 2,539,256 | 1/1951 | Leupold | 33/50 |
| 3,948,587 | 4/1976 | Rubbert | 356/21 |
| 4,285,137 | 8/1981 | Jennie | 33/246 |
| 4,584,776 | 4/1986 | Shepherd | 33/246 |

*Primary Examiner*—Charles T. Jordan
*Assistant Examiner*—Meena Chelliah
*Attorney, Agent, or Firm*—Rod D. Baker

[57] ABSTRACT

A hand-held analog calculator apparatus, and method for use thereof in the field, in association with firearms. The apparatus permits the user of a high-powered rifle equipped with a telescopic sight having a mildot reticle to quickly determine the range to target and the necessary elevation adjustment to compensate for bullet drop. Various logarithmic scales are disposed upon two rule members which slide parallel past each other. The scales display values corresponding to the mildot measurement, estimated target size, known bullet drop, and the like. By manipulating the rule members to align certain selected marks on particular scales, first the range to target value and then the necessary gun sight elevation adjustment and/or sight hold-over values are displayed on other scales. Optional components and scales also permit the user to determine any vertical angle between the user and the target, and calculate the horizontal distance to target for purposes of compensating for bullet drop. An interchangeable alternative rule member is provided to permit the invention to be used to calculate in either metric or English dimensional units.

37 Claims, 11 Drawing Sheets

RANGE, BULLET DROP, AND ANGLE CALCULATOR FOR USE WITH TELESCOPIC GUN SIGHTS

RELATED APPLICATIONS

This application is a continuation-in-part of my co-pending application Ser. No. 09/018,498, filed Feb. 4, 1998, entitled "Range and Drop Calculator for Use with Telescopic Gunsights," the entire disclosure of which is hereby incorporated by reference.

BACKGROUND OF THE INVENTION

A portion of the disclosure of this patent document contains material which is subject to copyright protection. The owner has no objection to the facsimile reproduction by anyone of the patent document or the patent disclosure, as it appears in the Patent and Trademark Office patent file or records, but otherwise reserves all copyright rights whatsoever.

1. Field of the Invention (Technical Field)

The present invention relates to an apparatus and method for determining in the field the range to target, and for adjusting the sight/aiming point to compensate for bullet drop or drift at that range, for a firearm, specifically for a firearm equipped with a telescopic sight having a mildot type of reticle.

2. Background Art

The mildot reticle is in increasingly widespread use by long-range rifle shooters as a means of estimating the range to the target. This estimation is critical in order to correct for the varying degree of projectile drop (and/or wind drift) as different ranges and thereby enable the shooter to hit the target. With training and familiarization, and by using the mildot reticle and then making the appropriate calculations, an experienced marksman can accurately estimate the range to target.

Initially incorporated into telescopic gun sights designed for military (and later police) use, the mildot reticle is the object of growing acceptance in the civilian sector among target shooters and hunters. By using a set of fixed dots within the telescopic sight, the shooter can compare the size of a target, a portion of the target, or a nearby reference target when viewed through the sight to the series of precisely sized and spaced dots on the reticle. On a mildot reticle, the dots are uniformly center-to-center spaced at 1 mil, which spacing appears to subtend a length of approximately 36 inches on a target viewed at 1000 yards. By estimating the size of the target or a reference near the target, and noting the number of mils that equal the size of the target, the shooter can apply a formula to calculate the range to target. This formula is simply expressed as: size of target in yards multiplied by 1000, and that product then divided by size of target in mils, equals range in yards. Currently, this calculation is performed in the field using a conventional hand-held electronic calculator.

The present method of using a mildot reticle poses several serious challenges to the shooter. The necessary calculations are somewhat complex, and depend upon the shooter's ability to correctly remember and apply the formula. Dimensional analysis further complicates the process, as the size of the target more often than not is mentally estimated in inches, necessitating an additional calculation to convert the target size into a decimal equivalent of yards. The shooter generally must carry and use an electronic digital calculator, necessitating numerous data entry steps.

Even after the shooter has performed the range calculation procedure, the amount of the bullet drop (or wind drift) applicable to the known range must be applied to the sight picture to enable an accurate aim that will result in a hit on target. Either the telescopic sight must be mechanically adjusted, or the sighting point (the intersection of the cross hairs) "held over," to correct the elevation (and/or windage) of the gun barrel to compensate for the effects of gravity and/or wind. Determining this compensation necessitates a second series of calculations to convert the needed amount of elevation or windage correction into a gun sight adjustment or hold-over figure for the known range and load.

Besides presenting many opportunities for arithmetic error, the correction calculations are time consuming, which may prove problematic in certain scenarios, such as military or law enforcement counter-sniping operations, timed competitive target-shooting events, or hunting situations.

A need remains, therefore, for a calculator apparatus which eliminates the multiple data entry steps and simplifies the calculation procedures for determining range to target and/or elevation adjustment to compensate for bullet drop or drift over the range determined. The present invention was developed to satisfy this previously unmet need.

SUMMARY OF THE INVENTION (DISCLOSURE OF THE INVENTION)

The present invention relates to an analog calculator apparatus and method incorporating two rule members, slidably connected together and bearing logarithmic and inverse logarithmic scales, configured and controllably movable specifically to perform simultaneously the following operations: (1) rapid and simple calculation of range to target, based on a measurement of the target with a mildot reticle, by aligning the estimated target dimension value on one scale directly opposite the mildot value on a second scale, and then reading from a third scale the range to target value aligned with an index mark; and, simultaneously and automatically, (2) rapid and simple calculation of the amount of gunsight correction necessary to compensate for bullet drop and/or wind drift for a given distance to target, enabling the user to determine either the equivalent telescopic sight adjustment (minute-of-angle) or the equivalent hold-over (mils), by aligning a bullet drop value on a fourth scale with an elevation compensation value in either or both minute-of-angle and mils, on fifth and sixth scales. There are also provided elements for determining the horizontal range to target in the event an uphill or downhill shot is to be attempted, in which the true horizontal distance to target is required to accurately compensate for bullet drop.

In accordance with the invention, there is provided an apparatus, useable with a telescopic sight having a mildot reticle, for determining the distance to a target of a known dimension, the apparatus comprising: a first rule member; a second rule member controllably moveable adjacent to the first rule member; a mildot scale, comprising mil value marks, on the first rule member; a range scale, comprising range value marks, on the second rule member; an index point on the first rule member proximate to the range scale; a target dimension scale, comprising dimension value marks, on the second rule member; and the second rule member controllably movable to align a dimension value mark corresponding to the known dimension with a selected mil value mark on the mildot scale, thereby aligning with the index point a range value mark corresponding to the distance to the target. The apparatus is useable with a firearm having a known bullet drop or drift over a known distance, and further comprises means for determining an adjustment to firearm elevation or windage to compensate for bullet drop or drift, the means for determining adjustment comprising at least one elevation scale, comprising elevation value marks, on the first rule member; and a bullet drop scale, comprising drop value marks, on the second rule member proximate to the at least one elevation scale; wherein when the second rule member is controllably moved to align the dimension value mark corresponding to the known dimension with a selected mil value mark on the mildot scale, a drop value mark corresponding to the known bullet drop is concurrently aligned with an elevation value mark, corresponding to the adjustment to firearm elevation or windage, on the at least one elevation scale.

Preferably, the first rule member defines a first rectangular aperture and a second rectangular aperture, and the second rule member is controllably movable parallel to the first rule member, with the target dimension scale and the range scale are at least partially visible through the first aperture and the bullet drop scale is at least partially visible through the second aperture. Ideally, the apparatus has an obverse face, and the mildot scale, the range scale, the index point, the target dimension scale, the at least one elevation scale, and the bullet drop scale are disposed upon the obverse face.

Preferably, the at least one elevation scale comprises a minute-of-angle elevation adjustment scale and a mil elevation adjustment scale.

It is preferred that the apparatus also features means for determining, when there is a vertical angle between the apparatus and the target, the horizontal distance to the target, and the means for determining the horizontal distance most preferably comprises means for measuring the vertical angle between the apparatus and the target. The means for measuring comprises a linear sight on one of the rule members, a plurality of angle marks on the first rule member, and a plumb pivotally attached to the first rule member and alignable by gravity with any one of the angle marks, wherein when the linear sight is aimed at the target, the plumb registers with one of the plurality of angle marks to indicate the vertical angle between the apparatus and the target. Also, there is an angle adjustment scale, comprising angle value marks, on the first rule member adjacent to the range scale, wherein an angle value mark corresponding to the vertical angle registers with a range value mark corresponding to the horizontal distance to the target.

In one embodiment of the invention, the range value marks, the dimension value marks, and the drop value marks are labeled in increments of inches or yards on a first side of the second rule member, while on a second side of the second rule member the dimension value and bullet drop value marks are labeled in increments of inches and the range value marks are labeled in meters. The invention preferably further comprises an optional, interchangeable metric second rule member, whose metric range scale has range value marks labeled in increments of meters, and target dimension and bullet drop value marks labeled in increments of centimeters, wherein the metric second rule member is positionable relative to the first rule member to dispose the metric range scale proximate to the index point and the metric bullet drop scale proximate to the at least one elevation scale.

Also according to the invention, there is provided an apparatus, useable with a telescopic sight having a mildot reticle, for determining the distance to a target of a known dimension, the apparatus comprising: a first rule member; a second rule member controllably moveable adjacent to the first rule member; a mildot scale, comprising mil value marks, on the first rule member; a range scale, comprising range value marks, on the first rule member; an index point on the second rule member proximate to the range scale; a target dimension scale, comprising dimension value marks, on the second rule member adjacent to the mildot scale; and the second rule member controllably movable to align a dimension value mark corresponding to the known dimension with a selected mil value mark on the mildot scale, thereby aligning the index point with a range value mark corresponding to the distance to the target. This embodiment, useable with a firearm having a known bullet drop or drift over a known distance, further comprises means for determining an adjustment to firearm elevation or windage to compensate for bullet drop or drift, the means for determining adjustment comprising at least one elevation scale, comprising elevation value marks, on the first rule member; and a bullet drop scale, comprising drop value marks, on the second rule member proximate to the at least one elevation scale, wherein when the second rule member is controllably moved to align the dimension value mark corresponding to the known dimension with a selected mil value mark on the mildot scale, a drop value mark corresponding to the known bullet drop is automatically concurrently aligned with an elevation value mark corresponding to the adjustment to firearm elevation or windage.

This embodiment of the invention likewise includes the finer features as described above, including the advantage that range-to-target and elevation adjustment values are simultaneously calculated with a single, one-time movable positioning of the second rule member in relation to the first rule member. Features are provided for determining the horizontal distance to target in instances when there is a vertical angle between the user and the target, and a dual-faced second rule member, providing for range-to-target calculations in either the English system or metric system of measurements, is also disclosed.

The invention also includes a method, useable with a firearm having a telescopic sight including a mildot reticle and having a known bullet drop or drift value over a known distance, for determining the range to a target of a known dimension and for determining an adjustment to firearm elevation or windage to compensate for bullet drop or drift, the method comprising the steps of: viewing the target through the scope; observing the number of mildots apparently occupied by the target to determine a mildot value; estimating the actual size of the target to determine a target dimension value; manipulating adjacent mildot and target dimension scales to align respective marks thereon corresponding to the mildot value and the known target dimension value; and viewing the alignment of an index point with a range value mark on a range-to-target scale, wherein the step of manipulating adjacent mildot and target dimension scales further comprises automatically and simultaneously manipulating a bullet drop scale to align a bullet drop value mark with an elevation value mark, on an elevation scale, corresponding to the adjustment to firearm elevation or windage. An optional additional feature permits the simultaneous determination of the horizontal distance to target, concurrently and automatically as a result of the manipulation of the rule members to calculate the range to target, in instances where there is a vertical angle between the user and the target. Other features of the method are explained as well.

A primary object of the present invention is to provide a rugged, non-digital, apparatus for quickly and simply determining actual and/or horizontal range to target, and correction of barrel elevation or windage, for firearms equipped with telescopic sights having a mildot reticle.

A primary advantage of the present invention is that it radically simplifies for users of mildot telescopic sights the calculations of actual and horizontal range to target and elevation or windage adjustment.

Another advantage of the invention is the provision of a calculator that is rugged, durable, easy to use, and requires no electrical power source.

Still another advantage of the present invention is the provision of a calculator apparatus which may be operated rapidly and quietly in the field, even in conditions of inclement weather.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

Figure 1:
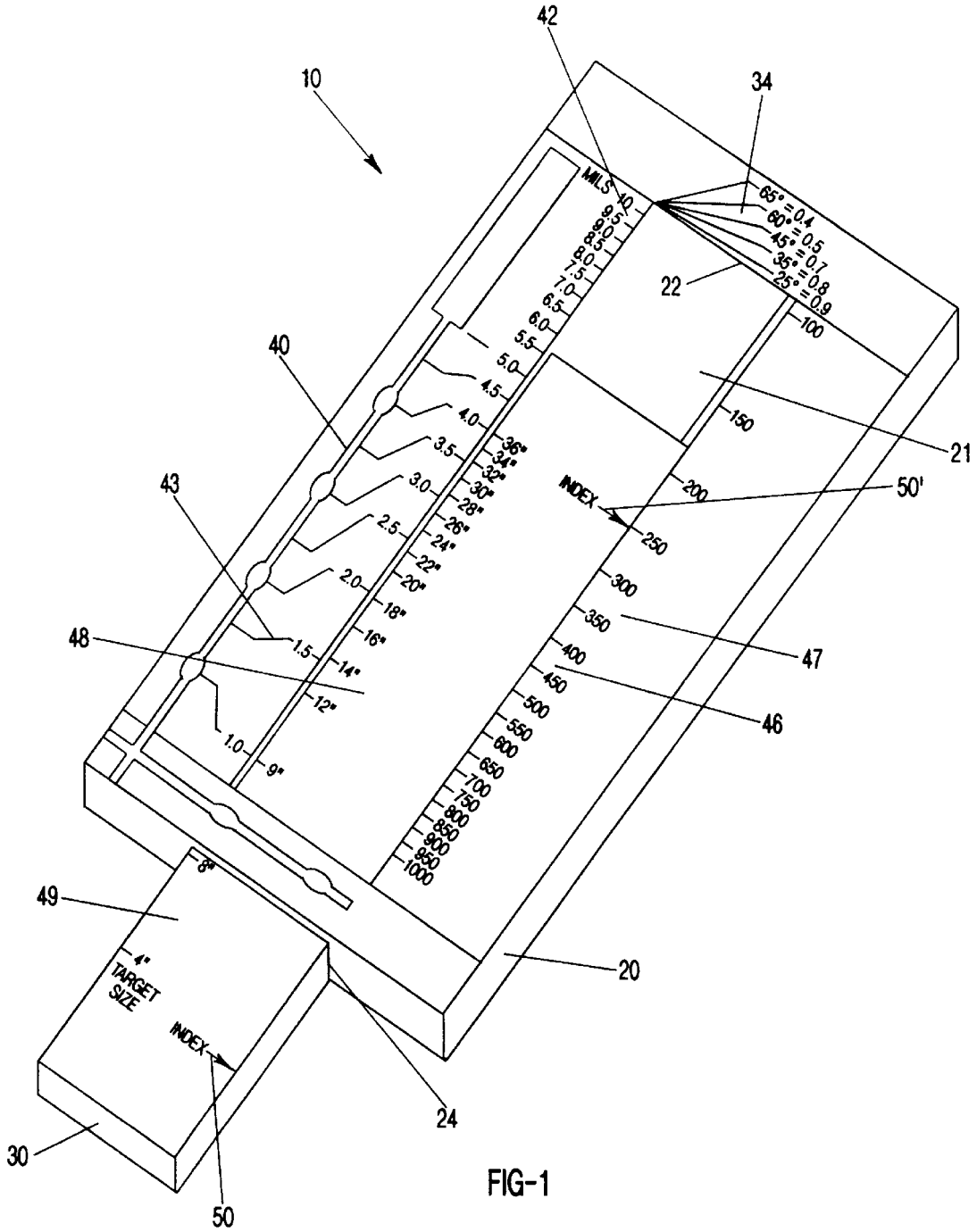
FIG. 1 is a perspective view of a preferred embodiment of the invention showing a first rule member and a second rule member.

DESCRIPTION OF THE PREFERRED EMBODIMENTS (BEST MODES FOR CARRYING OUT THE INVENTION)

The invention is an apparatus for use by sportsmen and sportswomen, military personnel or law enforcement personnel equipped with firearms having telescopic sights. It is contemplated that the telescopic sight typically is mounted upon a high-powered rifle, but the invention may find alternative uses with telescopic sights attached to other types of firearms or tools. To be suited for use in combination with the invention, the telescopic sight has a particular type of reticle (commonly also called "cross hairs") known as a "mildot" reticle. The apparatus is useable in the field for simply and rapidly determining approximate range to a target, and approximate adjustment to barrel elevation to compensate for bullet drop. The invention will find beneficial use in hunting, particularly big-game hunting, where the sportsman may have but a single opportunity to make an accurate long-distance shot. The invention also has military and law-enforcement applications, where the soldier or policeman is required to make long-distance shots with a high degree of accuracy, such as sniping or hostage rescue situations. The shooting enthusiast practicing long-range target shooting will also find the invention useful.

A preferred embodiment, broadly described, is a two-piece, hand-held, apparatus which permits the user to quickly and reliably improve his shooting accuracy in the field. The apparatus is reminiscent of a slide rule in that it includes ruled scales which may be slidably manipulated to perform analog calculations.

The apparatus of the invention is intended to be used in operative association with a telescopic sight having a mildot reticle. A reticle, generally defined, is a grid or rule placed in the eyepiece of the scope and used to establish position. A pair of perpendicular line reticles in the scope form the familiar "cross hairs" pattern used to establish the position of the barrel of the gun; when the intersection of the reticles is on the target when the target is viewed through the scope, the barrel of the gun is presumed to be aimed at the target. Reticles known in the art may have a series of uniformly spaced hash marks defining a graduated pattern along the length of the reticle. A mildot reticle has dots or ovoid marks ("mildots") about 0.25 mils (milliradians) long that are uniformly spaced at 1.0 mil. The mildot reticle scope is constructed such that the angle subtended by an object occupying the apparent distance between two mildots, when viewed through a scope for which the reticle is designed, is one milliradian. Accordingly, an object one meter wide in the field, when viewed through the scope from a distance of 1000 meters, will appear to occupy the distance between the centers of two adjacent mildots on the reticle.

Thus, using tacheometric principles borrowed from the art of land surveying, the graduated scale on the reticle permits the distance between the scope and the target to be estimated when the size of the target is known. By observing through the scope the number of mildot intervals (and partial intervals) apparently occupied by a target when viewed through the scope, the distance to target may be determined if the size of the target is known or may be reasonably accurately estimated.

FIG. 1 shows that one embodiment of the inventive analog calculator 10 features two rule members 20, 30 fashioned from plastic, wood, plastic-laminated paper, or other suitable durable, substantially rigid material. Most preferably, the rule members 20, 30 are molded from plastic or resin composite to provide durability under adverse field (e.g. moisture, rough handling) conditions as well as minimal coefficient of thermal expansion. Alternative, inexpensive embodiments may be fashioned from cardboard, plastic laminated paper, or the like. Materials which significantly expand and contract with changes in temperature should be avoided, as thermal expansion potentially adversely affects the accuracy of the invention. Since the calculator 10 typically is used outdoors, it may be subjected to extremes in temperature.

Preferably, the calculator 10 is sized for convenient use in the field. The device is suited for easy two-handed manipulation, and thus preferably should be from about 4.0 to about 12.0 cm wide, from about 12.0 to about 25.0 cm long, and from approximately 0.5 to 1.5 cm thick, although these dimensions are by way of example rather than limitation. Accordingly, the length, width, and thickness of the calculator 10 ideally permit the calculator to be hand-held in use, or stowed in a vest or pants pocket, or in a small exterior pocket on a knapsack or backpack when not in use.

As seen in FIG. 1, the first rule member 20 preferably has a planar, oblong, rectilinear frame-like shape featuring a peripheral solid portion circumscribing and defining an oblong longitudinal window or rectangular aperture 21 there through. The second rule member 30 also is generally planar with an oblong rectangular shape generally corresponding in size to the aperture 21 in the first rule member 20. The second rule member 30 accordingly is considerably narrower in lateral extent than the first rule member 20. The second rule member 30 preferably has a longitudinal dimension substantially equal to the overall length of the first frame member 20, although alternative embodiments may feature a longer second rule member 30.

The second rule member 30 is controllably movable adjacent to the first rule member 20. The first rule member 20 has in its ends a pair of slots 22, 24, corresponding generally in size and shape to the cross sectional size and shape of the second rule member 30, and penetrating the first rule member 20 longitudinally from its respective ends to the aperture 21. As suggested by the directional arrow in FIG. 1, the second rule member 30 is slidably insertable through the slots 22, 24 so that when thus inserted, the second rule member 30 is maintained in parallel relation to the first rule member 20. While disposed through the first rule member 20, the majority of the length of the second rule member 30 is visible through the aperture 21. The second rule member 30 has an oblong rectilinear shape movably disposed through the slots 22, 24 in the first rule member 20, and the second rule member 30 is controllably movable axially within the aperture 21, parallel to the first rule member 20. Desirably, the longitudinal edges of the aperture 21 are defined by tenons or ridges projecting inwardly from the first rule member 20, which are slidably engageable with mortises or grooved channels running along the longitudinal edges of the second rule member 20. Such slidable mortise-type joints serve to maintain the rule members 20, 30 in parallel movable conjunction throughout the full travel of the rule members, particularly when either end of the second rule member 30 happens to be withdrawn out of its nearby slot 22 or 24 during practice of the invention. By pulling and/or pushing on the ends of the second rule member 30 while holding steady the first rule member 20, the user is able controllably to move the second rule member 30 parallel to the first rule member 20. The second rule member 30 is sized to provide a mild frictional resistance to sliding movement of the rules 20, 30 with respect to each other, to reduce the likelihood of the rules inadvertently sliding apart and out of parallel contact.

In the preferred embodiment, the generally planar calculator 10 has an obverse face 25 and a reverse face 27, both of which preferably feature functional elements of the invention. The obverse face 25, seen in FIGS. 1 and 2, has rangefinder scales printed or engraved thereon which will be further described. The reverse face 27, which is viewed by simply turning the calculator 10 over, displays elevation adjustment scales thereon which also shall be described in detail. By making consecutive reference first to the obverse face 25 and then the reverse face 27 of the calculator 10, the user of the invention is able to perform a pair of related calculations using the single apparatus, as described herein below.

Figure 2:
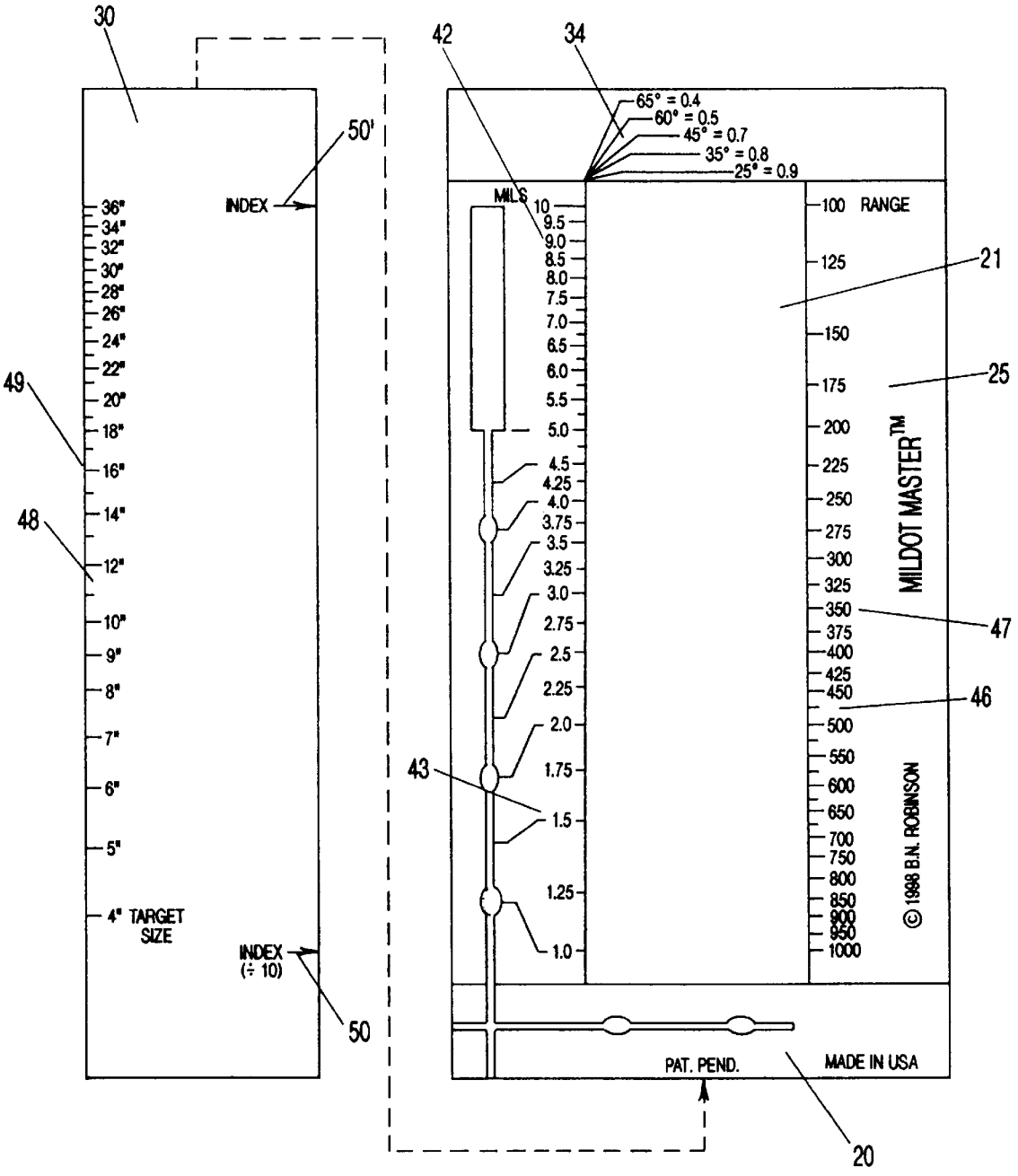
FIG. 2 is a plan view of the obverse face of the embodiment shown in FIG. 1, showing the rangefinder scales in one position.

Reference is made to FIG. 2, showing one preferred arrangement of the rangefinder scales appearing on the obverse face 25 of the calculator 10. The rangefinder scales are used to calculate the range to a target. The rangefinder scales collectively include an enlarged facsimile 40 of a portion of a mildot reticle, and parallel thereto, a mildot scale 42, both of which are printed, engraved, or otherwise presented upon, for example as illustrated, the left-hand side of the first rule member 20. (Throughout this disclosure, "top," "bottom," "left" and "right" will be used in the conventional manner to describe the apparatus of the invention as it appears in FIGS. 2–5, depicting the typical orientation of the apparatus when manipulated in the user's hands.) Running along the right hand side of the first rule member 20 is a first range scale 46. Thus, preferably, the aperture 21 is disposed parallel between the mildot scale 42 and the first range scale 46. As also seen in FIG. 2, disposed along the left-hand edge of the second rule member 30, substantially parallel to the mildot scale 42, is a target dimension scale 48.

The reticle facsimile 40 is an enlarged reproduction of a quarter section of a complete reticle, and preferably, but optionally, is provided upon the obverse face 25 to aid the user in mentally associating information viewed through the scope with the values set forth on the mildot scale 42. The invention may be practiced without referring to the reticle facsimile 40.

The mildot scale 42 comprises a plurality of mil value marks 43. As seen in FIG. 2, the mil value marks 43 are sequential numerals representing various corresponding values taken from the reticle. The typical horizontal or vertical line of a mildot reticle features ten mildot intervals (including the intersection point of the cross hairs). The mildot scale 42 accordingly features numerical values from 1.0 to 10.0, preferably labeled in intervals of 0.25. Notably, the mildot scale 42 is a common (Briggsian) logarithmic scale, with the mil value marks 43 spaced along the scale 42 logarithmically rather than uniformly. The mil value marks 43 are arranged in a logarithmic order from 1.0 at the bottom of the scale 42, near the bottom of the calculator 10, to 10.0 at the top, with the logarithmic spacing intervals decreasing from bottom to top as seen in FIG. 2. FIG. 2 also depicts how each mil value mark 43 preferably has an associated indicator line extending perpendicularly from the mark 43 to the edge of the aperture 21 to promote accurate observation of the registration between the mil value mark 43 and any one of the dimension value marks 49.

The target dimension scale 48 comprises a plurality of dimension value marks 49. As seen in FIG. 2, the dimension value marks 49 are sequential numerals representing various values corresponding to the dimension (known or estimated) of a given target. The typical target may have a horizontal or vertical dimension of between zero and about 36 inches. The target dimension scale 48 accordingly features numerical values from 4.0 to 36.0 (i.e. inches), preferably labeled in intervals of 1.0 inch. Like the mildot scale 42, the target dimension scale 48 is a common logarithmic scale, with the dimension value marks 49 spaced along the scale 48 logarithmically. The dimension value marks 49 are arranged in a logarithmic order from 4.0 at the bottom of the scale 48, nearer the bottom of the second rule member 30, to 36.0 at the top, with the logarithmic spacing intervals decreasing in size from bottom to top. FIG. 2 also shows that each dimension value mark 49 preferably has an associated indicator line extending perpendicularly from the mark 49 to the left edge of the second rule member 30 to promote accurate observation of the registration between a dimension value mark 49 and any one of the mil value marks 43.

The first range scale 46 comprises a plurality of first range value marks 47. As seen in FIG. 2, the first range value marks 47 are sequential numerals representing various values corresponding to the determined distance to a given target. The typical high-powered rifle target may have a distance, from the barrel, of between 100 and about 1000 yards. The first range scale 46 accordingly features numerical values from 100 to 1000 (i.e. yards), preferably labeled in intervals of 10 yards. Like the mildot scale 42 and the target dimension scale 48, the range scale 46 is a logarithmic scale, with the first range value marks 47 spaced along the scale 46 logarithmically. The range value marks 47 are arranged in an inverse logarithmic order from 1000 at the bottom of the scale 46, nearer the bottom of the first rule member 20, to 100 at the top, with the logarithmic spacing intervals increasing in size from bottom to top. FIG. 2 also shows that each first range value mark 47 preferably has an associated indicator line extending perpendicularly from the mark 47 to the right edge of the aperture 21 to promote accurate observation of the registration between a first range value mark 47 and either one of the first index marks 50, 50'.

The obverse side of the second rule member 30 is provided with at least one, and preferably two first index points 50, 50' thereon. Both index points are situated on the right hand edge of the second rule member 30 so as to be proximate to the range scale 46. The lower index point 50 is located nearer the bottom end of the second rule member 30, and the upper index point 50' is provided nearer the top end. As illustrated in FIG. 2, the index points are longitudinally spaced apart by a longitudinal distance approximately equal to the length of the first range scale 46, so that when the second rule member 30 is controllably moved to align the bottom index point 50 with the bottom range value mark (e.g. 1000), the upper index point 50' is aligned with the top range value mark (e.g. 100). Less desirable alternative embodiments of the calculator 10 may be crafted with only one index point, ordinarily the lower index point 50. While functional, such alternative embodiments have a range of calculation somewhat limited by the lone index point's moving physically beyond the extreme value on the first range scale 46.

As depicted in FIG. 2, the mildot scale 42, the target dimension scale 48, and the first range scale 46 have equal longitudinal extent. The respective upper and lower termini of the mildot scale 42 and the first range scale 46 are longitudinally aligned in fixed positions on opposite sides of the aperture 21; imaginary lines running perpendicular to the longitudinal axis of the calculator 10 and passing through a terminus of one of the scales 42, 46 also passes through the terminus of the other scale. Similarly, the second rule member 30 can be controllably moved to co-align simultaneously the termini of the target dimension scale 48 and the first index points 50, 50' with the termini of the scales 42, 46 disposed upon the first rule member.

Figure 3:
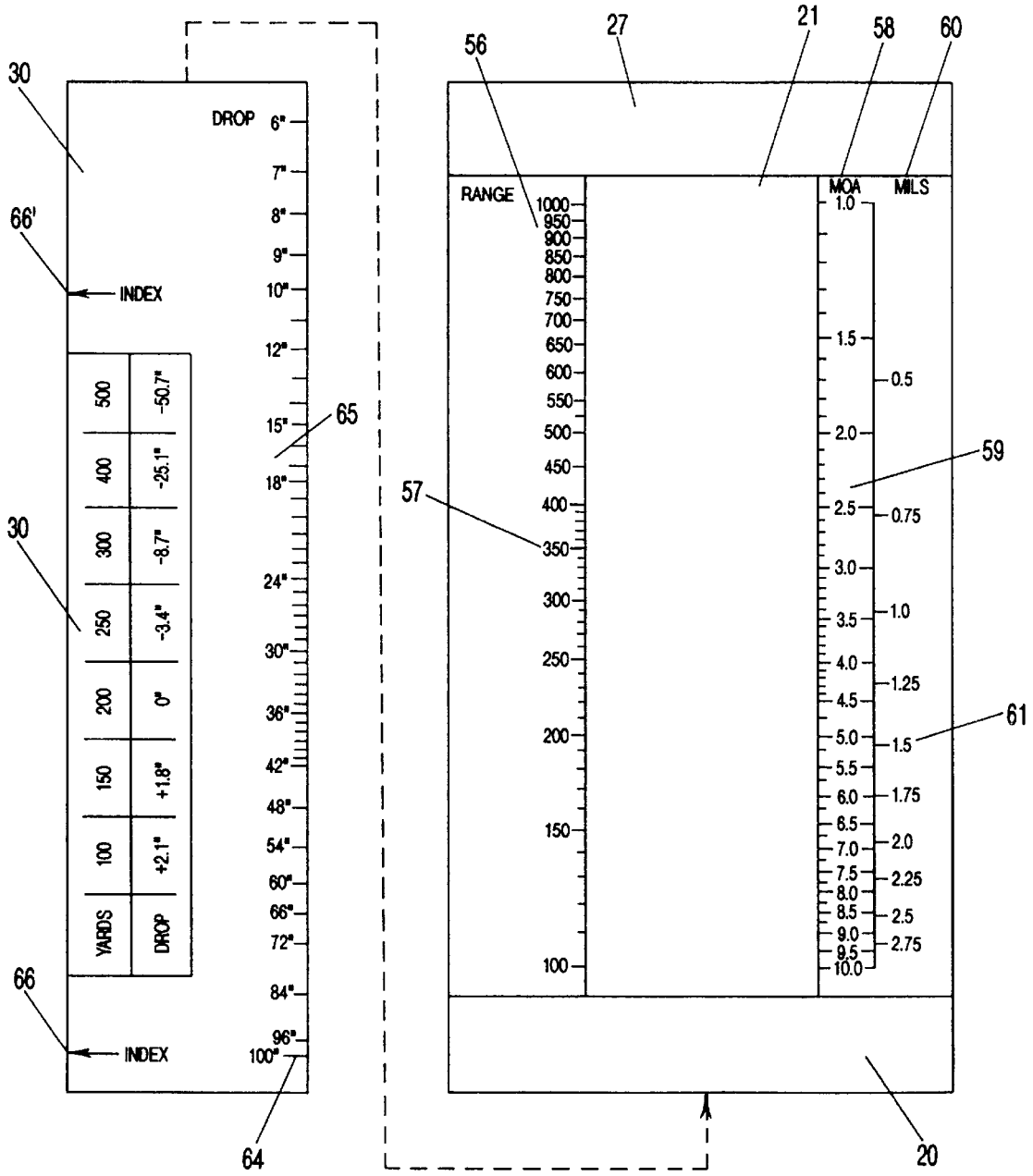
FIG. 3 is a plan view of the reverse face of the embodiment shown in FIG. 1, showing the elevation adjustment scales in one position.

The elevation adjustment scales are used to determine the appropriate adjustment in the elevation of the gun barrel to compensate for bullet drop over the distance to target. Alternatively, the elevation adjustment scales may be used to compensate for bullet drift due to the effects of wind. The determination of compensation for wind drift is performed in a manner very similar to the determination of drop compensation, and will be apparent to one skilled in the art. In the specification and the claims, "drop" may generally be read to include "drift" unless otherwise indicated. Such actual drop and drift compensations ordinarily are accomplished by adjusting the telescopic sight, or by "holding over" the cross hairs above (or to the side of) the image of the target viewed through the scope. FIG. 3 shows one preferred arrangement of the elevation adjustment scales appearing on the reverse face 27 of the calculator 10. The elevation adjustment scales preferably are axially reversed with respect to the rangefinder scales, so that if the reverse face 27 is viewed merely by rotating the calculator 10 axially, the elevation adjustment scales will appear upside down. Accordingly, the reverse face 27 is viewed by flipping the calculator 10 over and rotating it around an axis normal to the faces 25, 27 to bring the reverse face 27 into the position seen in FIG. 3.

The elevation adjustment scales collectively include a second range scale 56 along the one side of the first rule member 20, and at least one, and preferably two, elevation scales 58, 60 on the other side of the first rule member. Preferably, the aperture 21 is disposed parallel between the second range scale 56 and the elevation scales 58, 60. The second rule member 30 has a bullet drop scale 64 along one edge substantially parallel and adjacent to the elevation scales 58, 60. On the other edge of the second rule member 30 are one or two second index points 66, 66'.

The second range scale 56 is similar to the first range scale 46, and comprises a plurality of second range value marks 57. As seen in FIG. 3, the second range value marks 57 are sequential numerals representing various values, e.g 100 yards to 1000 yards, corresponding to potential distances to a particular target. The second range scale 56 accordingly features numerical values from 100 to 1000 (i.e. yards), preferably labeled in intervals of 10–25 yards, spaced along the scale 56 logarithmically. The range value marks 57 are arranged in an inverse logarithmic order from 100 at the bottom of the scale 56, nearer the bottom of the first rule member 20 as viewed in FIG. 3, to 1000 at the top, with the spacing intervals decreasing in size from bottom to top. FIG. 3 also shows that each second range value mark 57 preferably has an associated indicator line extending perpendicularly from the mark 57 to the left edge of the aperture 21 to promote accurate observation of the registration between a second range value mark 57 and either one of the second index marks 66, 66'.

The reverse side of the second rule member 30 is provided with at least one, and preferably two second index points 66, 66' thereon. Both second index points 66, 66' are situated on the left hand edge of the second rule member 30, as viewed in FIG. 3, so as to be proximate to the second range scale 56. The lower index point 66 is located nearer the bottom end of the second rule member 30, and the upper index point 66' is provided nearer the top end. As illustrated in FIG. 3, the index points are spaced apart by a longitudinal distance equal to the length of the second range scale 56, so that when the second rule member 30 is controllably moved to align the bottom index point 66 with the bottom range value mark (e.g. 100), the upper index point 66' is aligned with the topmost range value mark (e.g. 1000).

Opposite the index points 66, 66' on the second rule member 30 is the bullet drop scale 64, including a plurality of drop value marks 65. Projected over a distance of from 100 to 1000 yards, the bullet shot from a typically loaded firearm will drop, due to the force of gravity. As seen in FIG. 3, the drop value marks 65 are sequential numerals representing various values (e.g. 1.0 inch to 100 inches) corresponding to the bullet drop for a given shot. The bullet drop scale 64 accordingly features numerical values from, for example, 10 to 96, preferably labeled in intervals of 1.0 inch (except the first labeled partial interval from 10 to 12), spaced along the scale 64 logarithmically. The drop value marks 65 are arranged in logarithmic order from 96 at the bottom of the scale 64, nearer the bottom of the first rule member 20 as viewed in FIG. 3, to 6.0 at the top, with the logarithmic spacing intervals increasing in size from bottom to top. FIG. 3 also shows that each drop value mark 65 preferably has an associated indicator line extending perpendicularly from the mark 65 to the right edge of the second rule member 30 to promote accurate observation of the registration between any drop value mark 65 and any of the elevation value marks 59, 61.

The elevation scales 58, 60 are upon the opposite side of the aperture 21 from the second range scale 56. The invention functions with either of the elevation scales 58, 60 used singly, but the preferred embodiment is provided with dual scales 58, 60 to permit the user to select the better of two available modes of elevation adjustment in a given situation. A minute-of-angle (MOA) elevation scale 58 is provided parallel alongside a mil elevation scale 60.

The MOA elevation scale 58 comprises a plurality of minute-of-angle elevation value marks 59. As seen in FIG. 3, the MOA elevation value marks 59 are sequential numerals representing various values corresponding to a determined adjustment to barrel elevation, measured in angle minutes, needed to compensate for a known bullet drop. The elevation of a typical high-powered rifle, with a typical cartridge load, may need to be adjusted anywhere from 1.0 to 10.0 minutes (or multiples thereof), for example, to compensate for the bullet drop over a distance of 100 to 1000 yards. The MOA elevation value scale 58 accordingly features numerical values from 1.0 to 10.0, preferably labeled in intervals of 0.25 minutes. The MOA elevation scale 58 is a logarithmic scale, with elevation value marks 59 spaced along the scale 58 logarithmically from 10.0 at the bottom of the scale 58, nearer the bottom of the first rule member 20, to 1.0 at the top, with the logarithmic spacing intervals increasing in size from bottom to top. FIG. 3 also shows that each MOA elevation value mark 59 preferably has an associated indicator line extending perpendicularly from the mark 59 to the left edge of the aperture 21 to promote accurate observation of the registration between an elevation value mark 59 and any one of the bullet drop value marks 65.

The mil elevation scale 60 comprises a plurality of mil elevation value marks 61. As seen in FIG. 3, the mil elevation value marks 61 are sequential numerals representing various values corresponding to a determined adjustment to barrel elevation, measured in milliradians (mildots viewed through the scope), needed to compensate for a known bullet drop. A milliradian approximately equals 3.438 minutes of angle. The elevation of a typical high-powered rifle, with a typical cartridge load, may need to be adjusted anywhere from 0 to 2.5 mils, or multiples thereof for example, to compensate for the bullet drop over a distance of 100 to 1000 yards. The mil elevation scale 60 accordingly features numerical values from 0 to at least 2.5, preferably labeled in intervals of 0.25 mils. The mil elevation scale 60 is a logarithmic scale, with elevation value marks 61 spaced along the scale 60 logarithmically from about 2.5 at the bottom of the scale, as viewed in FIG. 3, to about 0.0 at the top, with the spacing intervals increasing in size from bottom to top.

The distance a bullet drops due to gravity, over a given range, is a function of several variables. The most important factors are the type of firearm used, and the "load" on the bullet cartridges fired. The higher the "load," the higher the bullet velocity and hence a reduced amount of drop. Load can be affected by the quantity and the quality of the gunpowder in the cartridges in use. The amount of drop for a given range, for a given firearm, must accordingly be determined before going into the field. It is known in the art to determine the bullet drop from information provided by the firearm and cartridge manufacturers, or from testing.

The user of the calculator 10 of the present invention therefor must have access in the field to a means for correlating range to target with bullet drop. For example, the user will need to know, or have ready access to a reference showing, that at a range of 250 yards his particular gun and load will result in a drop of approximately 3.4 inches, that at range 300 yards the drop increases to about 8.7 inches, and at 500 yards the drop is about 50.7 inches, and the like. Presently, the long range shooter commonly carries into the field a small chart tabulating the specific range-to-target and corresponding bullet drop values for his particular firearm and load. This chart frequently is carried taped to the stock of the firearm. The present calculator 10 features an elongated space upon the reverse side of the second rule portion 30 where such a customized drop chart 33 may be temporarily affixed. The drop chart 33 thus is conveniently located for reference during the practice of the invention. The space on the calculator 10 may be sized, for example, to receive thereon a DROP DECAL™ available from EXD Engineering, Inc. of Lawrence, Kans., USA, with the proper range and drop data entered thereon. Alternatively, the user may choose to simply prepare his own version of the drop chart 33 on an appropriately sized sheet of paper, and affix the chart to the calculator using transparent tape or the like. The user should then verify the accuracy of his chart by sight testing his firearm prior to entering the field. Thus, the drop chart 33 serves as a means, preferably on the second rule member 30, for determining a bullet drop value for the previously determined known distance.

Range calculations, whether performed having reference to a mildot reticle or by some other means, are a measure of the actual, "line-of-sight" distance to the target. Bullet drop figures, however, are always expressed in terms of deviation from a horizontal trajectory. It is important to note, therefore, that bullet drop figures are not accurate if a particular shot is uphill or downhill. The range determination on such shots must be adjusted to promote accurate shooting. If shooting uphill or down hill (for example, when hunting in mountainous terrain), the user must estimate the angle by which the shot deviates from horizontal, and reduce the estimated range accordingly. This lesser "actual horizontal range" determines the actual bullet drop, and is the basis of the calculations performed for sight adjustment or hold-over corrections. Whether a particular shot is uphill or downhill is not relevant, the affect on bullet drop is the same; the actual horizontal range is less than the angled line-of-sight range.

The calculator 10 optionally may be provided on a face thereof with a range correction graph 34 to assist in making the conversion form line-of-sight distance to actual horizontal range. The range correction chart 34 graphically expresses the information which allows a quick conversion of estimated line-of-sight range into actual horizontal range. Once the user has used the mildot reticle and the rangefinders scales of the calculator 10 to determine the line-of-sight range, a reference to the graph 34 would provide the correction factor (a value less than unity) multiplier to be applied to determine the actual horizontal range. Thus, the graph 34 functions as a means, preferably on the first rule member 20, for determining a range correction factor for vertically angled shots. The bullet drop figure may then be properly selected using the actual horizontal range. An alternative embodiment of the invention, disclosed hereafter, provides optional features for more accurately measuring the vertical angle involved in an uphill or downhill shot, and calculating the horizontal distance to the target.

The operation of the apparatus of the invention is now described by way of example. In the field, a target such as a deer is identified. The deer is viewed through the telescopic sight having a mildot reticle. The user estimates the actual size of the target by, for example, estimating the breadth of the deer's breast to be 18 inches. (If the target size cannot be confidently estimated, or if the target is very small, a "reference target," i.e. an object whose size can be accurately estimated, which is the same distance from the user and nearby the actual target, is selected and viewed through the scope. An example of the later situation would be a deer of unknown size standing next to a fence estimated to be five feet high; the fence could be used as the reference target.) The user then views the deer through the scope, carefully observing how many intervals (e.g. spaces between mildots), including fractional intervals, on a reticle are occupied by the deer's breast when viewed through the scope. In this example, the deer's breast is observed to occupy 1.5 mildot intervals.

Figure 4:
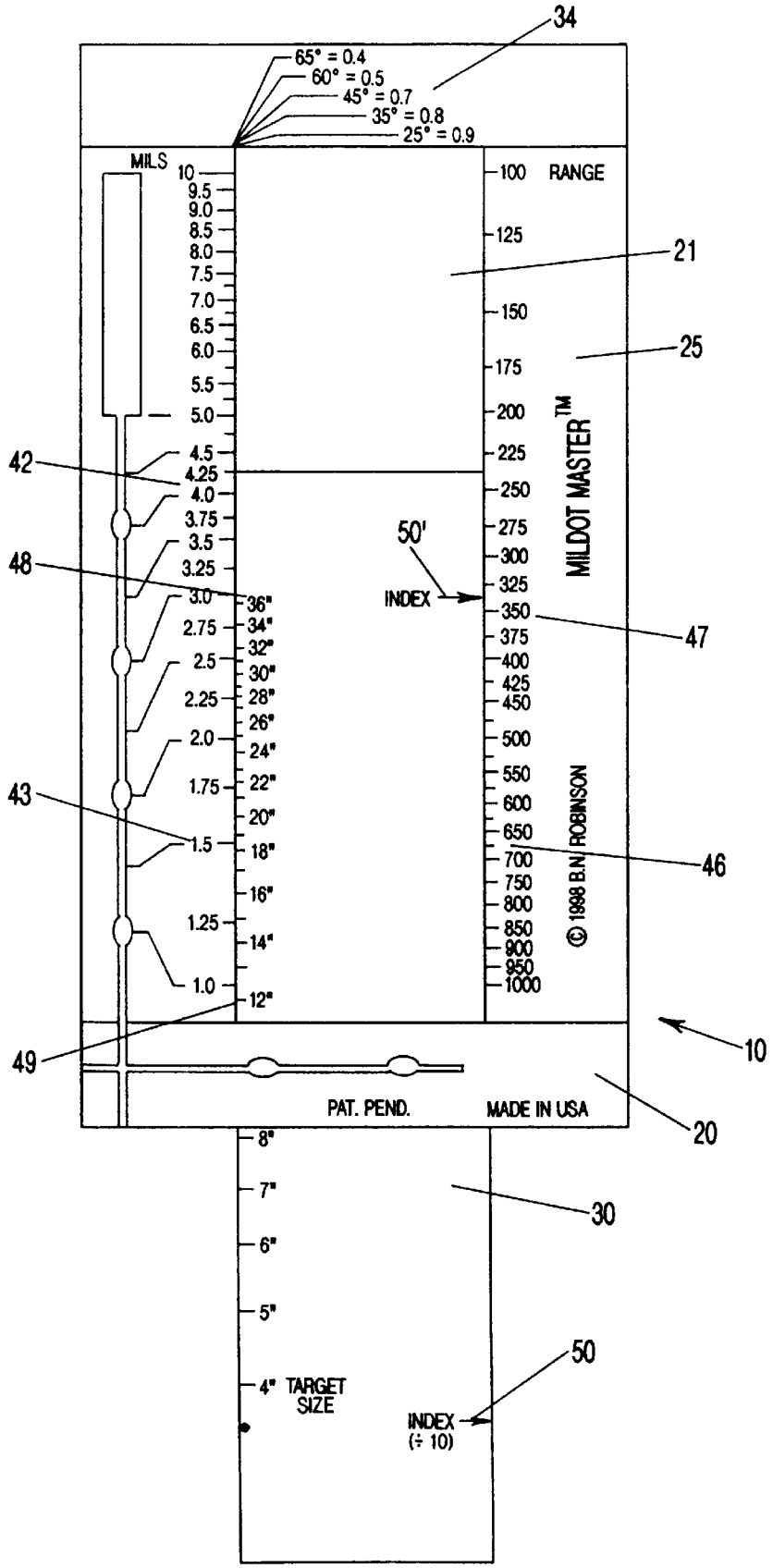
FIG. 4 is a plan view of the rangefinder scales in another position for making a particular calculation.

The calculator is taken in hand with the obverse face 25 in plain view. The second rule member 30 is controllably moved with respect to the first rule member 20 to align the dimension value mark 49 corresponding to the estimated target dimension (in this example, 18") with a mil value mark 43, in this example 1.5, selected to correspond to the mildot interval occupied by the target. With the 18-inch dimension value mark on the target dimension scale 48 thus aligned with the selected mil value mark of 1.5 on the mildot scale 42, the obverse face 25 of the calculator will be in the position shown in FIG. 4. Referring to FIG. 4, it is seen that with the 18" dimension value mark aligned with the 1.5 mil value mark, the upper index point 50' is aligned between the range value marks corresponding to ranges of 300 yards and 350 yards, near the mark corresponding to 330 yards. The user visually reads (or interpolates, if necessary on a less finely divided scale) that the upper index point 50' is aligned with the range value mark of 330 yards. The upper index point 50' thus is aligned with a range value mark corresponding to the distance to the target. The line-of-sight range to target is thereby determined to be about 330 yards.

The apparatus is designed such that, with the wide range of combinations of target dimensions and mildot measurements, one of the first index points 50, 50' will align with a first range value mark 47 for practically every determined combination. For a given calculation, the user simply uses whichever one of the two first index points 50, 50' is aligned with a range value. If the estimated target dimension is greater than the maximum value on the target dimension scale 48, the user simply selects a dimension value mark 49 corresponding to half the estimated size, and then doubles the resulting range value to determine the actual range to target.

Once the range to target has been determined the user must now either adjust the telescopic sight or change the sight picture (hold-over) to compensate for the bullet drop at the determined range. A second calculation accordingly must be performed in order to convert bullet drop at the determined range into an appropriate elevation correction factor. The present invention simplifies this process by performing both sight adjustment and hold-over calculations simultaneously, for the specific bullet drop figure at a specific range.

Figure 5:
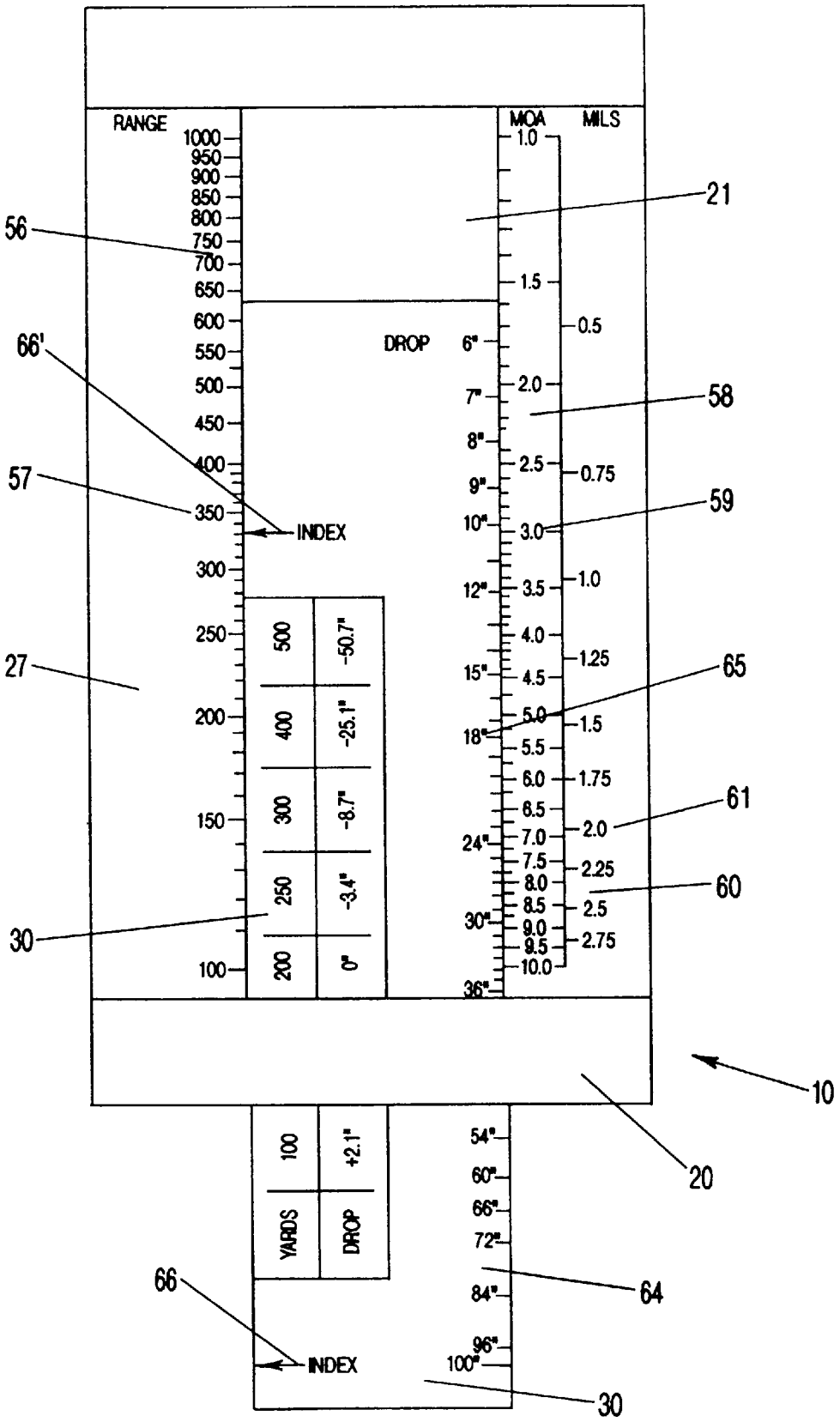
FIG. 5 is a plan view of the elevation adjustment scales in another position for making a particular calculation.

The calculator 10 is obverted to place the reverse face 27 in plain view as seen in FIG. 5. The second rule member 30 is controllably moved (if necessary) to align one of the second index points 66, 66', in this example the upper index point 66', with the second range value mark 57 (on the second range scale 56) corresponding to the determined range, in this example, 330 yards. Consulting the drop chart 33 on the second rule member 30 or elsewhere, the user interpolates that, for the known load and firearm, the bullet drop over 330 yards is about 10 inches (i.e. as interpolated between the values −8.7" and −25.1" appearing correspondent the range values of 300 yards and 400 yards, respectively, manifested on the drop chart 33). With the index point 66' aligned with the range value mark corresponding to 330 yards, the drop value mark 65 corresponding to the ascertained drop value (e.g. 10 inches) is automatically approximately aligned with the determined elevation adjustment values readable from either of the elevation scales 58, 60. In this example, as seen in FIG. 5, the drop value mark corresponding to 10" is aligned with the minute-of-angle mark corresponding to a MOA value of 3.0 on the MOA elevation scale 58, and a mil value of about 0.8 mils on the mil elevation scale 60. Accordingly, the determined elevation adjustment values are 3.0 minutes-of-angle, and 0.8 mils. The user can select either one of the determined elevation adjustment values for use. The user corrects for the amount of drop by either holding over by 0.8 mildots in the reticle when the target is viewed through the scope, or by adjusting the elevation of the telescopic sight to raise the point of impact by 3.0 MOA.

Of course, if one index point 66 used with a determined range and bullet drop value puts the bullet drop value mark 65 "off the scale", the second rule member 30 simply is controllably moved to place the other index point 66' in alignment at the proper location along the second range scale 56, which will place the drop value mark 65 (in this example, 10") in alignment with the appropriate MOA and mil elevation marks 59, 61.

If the bullet drop value is less than the minimum value appearing on the bullet drop scale 64, the actual value may simply be doubled and the value corresponding to the resulting product used on the bullet drop scale 64. Half of the indicated correction amount is then used to compensate for the actual drop.

The calculator 10 may be configured so that when the proper registrations have been made on the obverse face 25 to determine the range to target for certain ranges, the calculator need merely be turned over to reveal the proper elevation adjustment values, without any need to further manipulate the rule members 20, 30 (assuming the required bullet drop for that range is not off-scale). Stated differently, in one preferred embodiment of the invention, the rangefinder scales and the elevation adjustment scales are so arranged such that the alignment of the proper respective values on the first range scale 46 and the mildot scale 42 will automatically and simultaneously result in the proper alignment of the proper bullet drop value on the bullet drop scale 64 with the correct elevation adjustment values on the elevation scales 58, 60.

In the foregoing example, the shots were assumed to be taken on the horizontal. If the shot were to be taken, for further example, uphill at an angle of 45° the determined line-of-sight value (e.g. 330 yards, would be greater than the actual horizontal range that the bullet would travel. A bullet drop value selected from the drop chart 33 would thus be excessive, and the actual point of impact would be too high. By referring to the horizontal range correction graph 34 on the obverse side 25 of the calculator 10, the user notes that a 45-degree slop indicates a correction factor of 0.7. This correction factor allows a quick conversion of estimated line-of sight range into actual horizontal range. The example, the line-of-sight range (330 yards) is multiplied by the correction factor of 0.7, yielding an actual horizontal range of approximately 230 yards. The user refers to the drop chart 33, but applies the corrected range of 230 yards to the drop chart 33 to determine the proper bullet drop value to be utilized in further calculation of the elevation adjustment. But because the line-of-sight distance to target is still 330 yards, the second index point 66' nevertheless is aligned with the line-of-sight value of 330 yards; only the selected bullet drop value mark 65 on the bullet drop scale 64 is changed to account for the angle of the shot.

The shooter of ordinary skill also is able to use the calculator 10 to determine adjustments to windage account for wind drift. Wind drift can be estimated by several methods known in the art, and the shooter must develop drift estimation skills to ensure consistent long-range hits under windy conditions. The calculator 10 may be utilized to convert a wind drift estimation into a sight adjustment figure (MOA) or a hold-over figure (mils) in the same manner as determining a bullet drop correction.

Notably, all the scales 42, 46, 48, 56, 58, 60 and 64 are herein exemplified as each having a finite quantity of value marks physically spaced logarithmically. It will be immediately appreciated by a person of ordinary skill in the art that it is not pragmatic, or even possible, to provide any scale with an infinite quantity of value marks physically spaced apart by infinitesimally small intervals. Accordingly, when the calculator 10 is in proper use, an index point 50 or 50' or 66 or 66', or some selected value mark on one scale, will not align perfectly with a specifically labeled value mark on another scale for all potential calculations. Accordingly, it is understood that in this description and in the claims, the concept of "alignment" of an index point or a value mark on one scale with a value mark on some other scale includes the practice of visual or mental interpolation of values from the other scale in those instances when exact registration between labeled value marks is not achieved.

Figure 6:
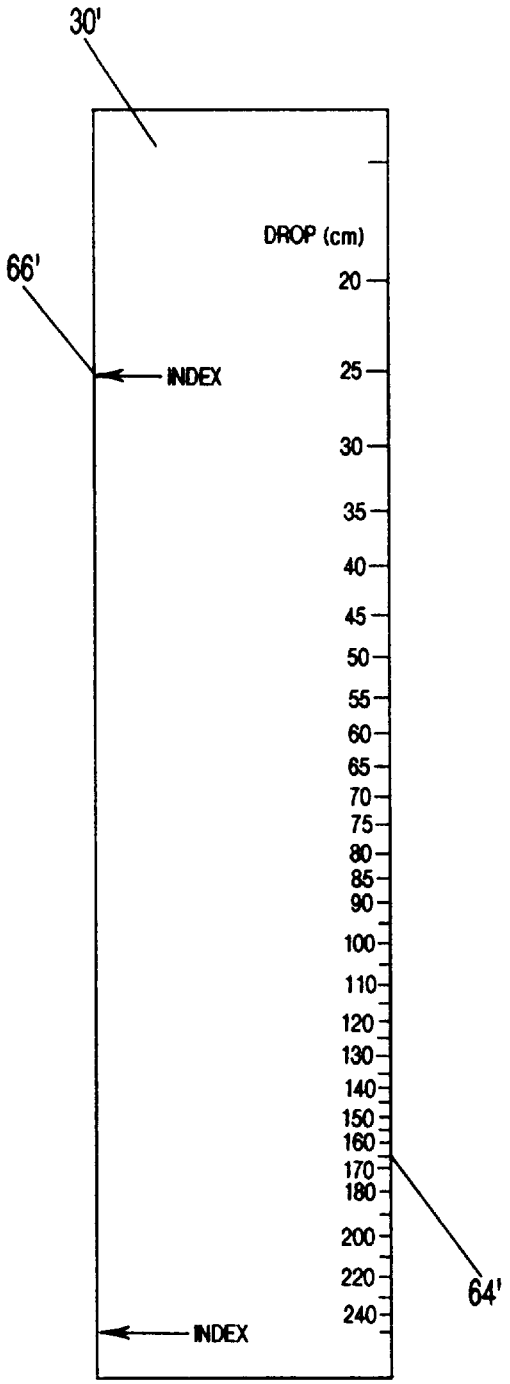
FIG. 6 is a plan view of an alternative embodiment of the second rule member shown in FIG. 3.
Figure 7:
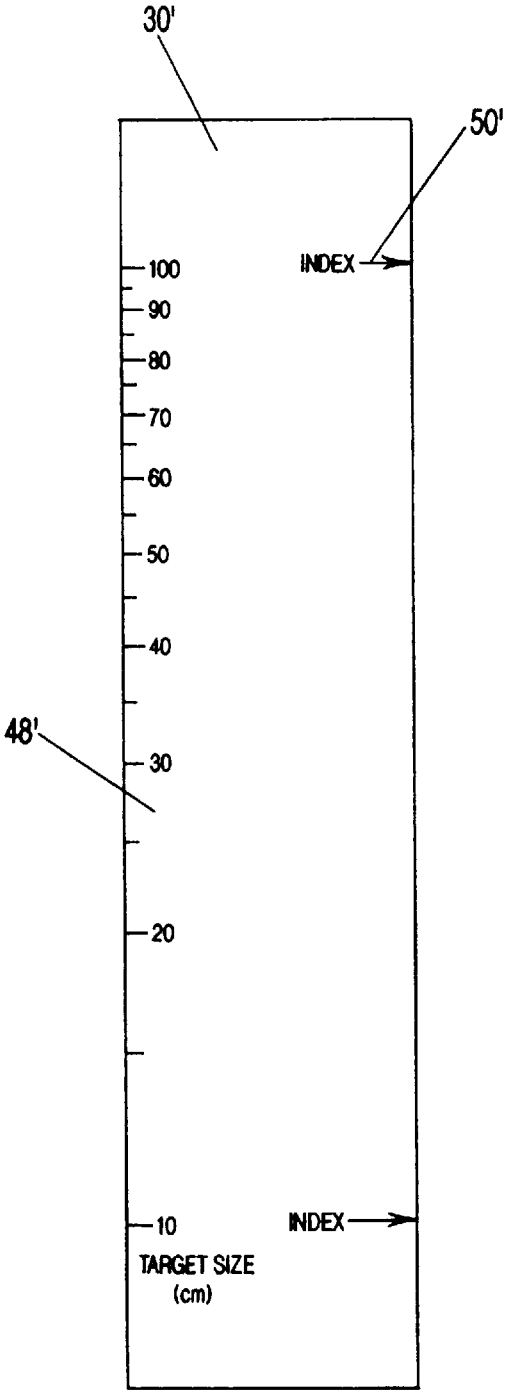
FIG. 7 is a plan view of an alternative embodiment of the second rule member shown in FIG. 2.

A distinct advantage of the invention is that the second rule member 30 is interchangeable to permit the calculator 10 to be adapted to either English (yards and inches) or metric (meters and centimeters) calculations. Reference to FIGS. 2 and 3 reveals that the range scales 46, 56 are not specifically limited to or labeled to pertain to "yards." The range scales 46, 56 accordingly may also be used whereby the first and second range value marks 47, 57 denote meters, rather than yards. FIGS. 6 and 7 show the reverse and inverse faces, respectively, of an alternative embodiment of the second rule member 30 useable to perform metric calculations. The dual-faced metric second rule member 30' is substantially the same as the two-faced English second rule member 30, except that the target dimension scale 48' (FIG. 7) is labeled in centimeters, e.g. 10 cm to 100 cm, rather than inches, and the bullet drop scale 64' (FIG. 6) is labeled in centimeters, e.g. 20 cm to 240 cm, rather than inches.

The two-faced metric second rule member 30' is sized and shaped substantially identically to the English second rule member 30. Consequently, the two second rule members 30 and 30' are physically interchangeable for insertion into and axial movement in relation to the first rule member 20. To adapt his calculator 10 for metric use, the user of the invention simply slides the English second rule member 30 out of the first rule member 20, and inserts the metric second rule member 30' in lieu thereof and in the same relative orientation. The calculator 10 may then be used in the same manner, regarding the manipulation of the rule members 20 and 30', as previously explained herein. Only the dimensional system is different, and the dimensional conversions are automatically performed by the use of the metric second rule member 30'. The proper readout is still obtained from the first range scale 46 (interpreted in meters) and from the MOA and mil elevation adjustment scales 58, 60.

FIGS. 8–11 collectively depict another embodiment of the invention which is preferred for its simplicity of use and for its additional feature of including means for the user to determine the horizontal distance to a target in those situations where there is a vertical angle between the user and the target. The embodiment of FIGS. 8–11 is substantially similar to the previously described embodiments both in function and construction, except as explained hereafter, and the configuration and manner of using this embodiment are readily understood from the foregoing.

The embodiment of the calculator 10 shown in FIGS. 8–11 presents several noteworthy advantages. First, all the scales for determining range and elevation adjustment are disposed on a single planar side or face 25 of the apparatus, permitting the invention to be practiced without having to "flip" or turn the apparatus over. Also, the second rule member 30 need be manipulated but a single time to render readouts of distance to target as well as elevation/windage adjustment values. With the target dimension scale 48', the range scale 46', and the bullet drop scale 64' specially positioned on a single side of the second rule member 30, the act of controllably moving any particular target dimension value mark 49' into alignment with a selected mil value mark 43' automatically, concurrently and simultaneously aligns the proper bullet drop value mark 65' with the appropriate one of the elevation value marks 59' and/or 61' on one or both elevation scales 58', 60'. Thus, the user need controllably move the rule members 20, 30 with respect to each other only once; when the user aligns the mil value mark 43 corresponding to the target (as viewed through the reticle) with the known target dimension value mark selected on the target dimension scale 48', the calculator 10 at the same time draws the drop value mark 65' pertaining to the particular firearm and cartridge load into alignment with the elevation value mark 59' or 61' corresponding to the necessary correction for drop or windage. The need to move the rule member 30 a single time permits the invention to be used quickly and reduces the frequency of mistakes, compared to the previously described two-sided embodiment of FIG. 1.

Additionally, the embodiment of FIGS. 8–11 provides means for the user to calculate the horizontal distance to target when the user is above or below the target, for example when shooting from a hillside down at an elk in a valley. Such calculations are important for shooting accuracy, particularly with respect to corrections accounting for bullet drop due to gravity. A correction to firearm elevation to account for bullet drop is most accurately performed when horizontal distance, rather than line-of-sight actual distance, is considered, since the effect of gravity is independent of whether the bullet is traveling at some angle with respect to vertical. The difference becomes critical when employing the "known" bullet drop value for a given rifle, cartridge, and bullet weight combination, since such "known" values are calculated under controlled firing along a horizontal firing line.

Figure 8:
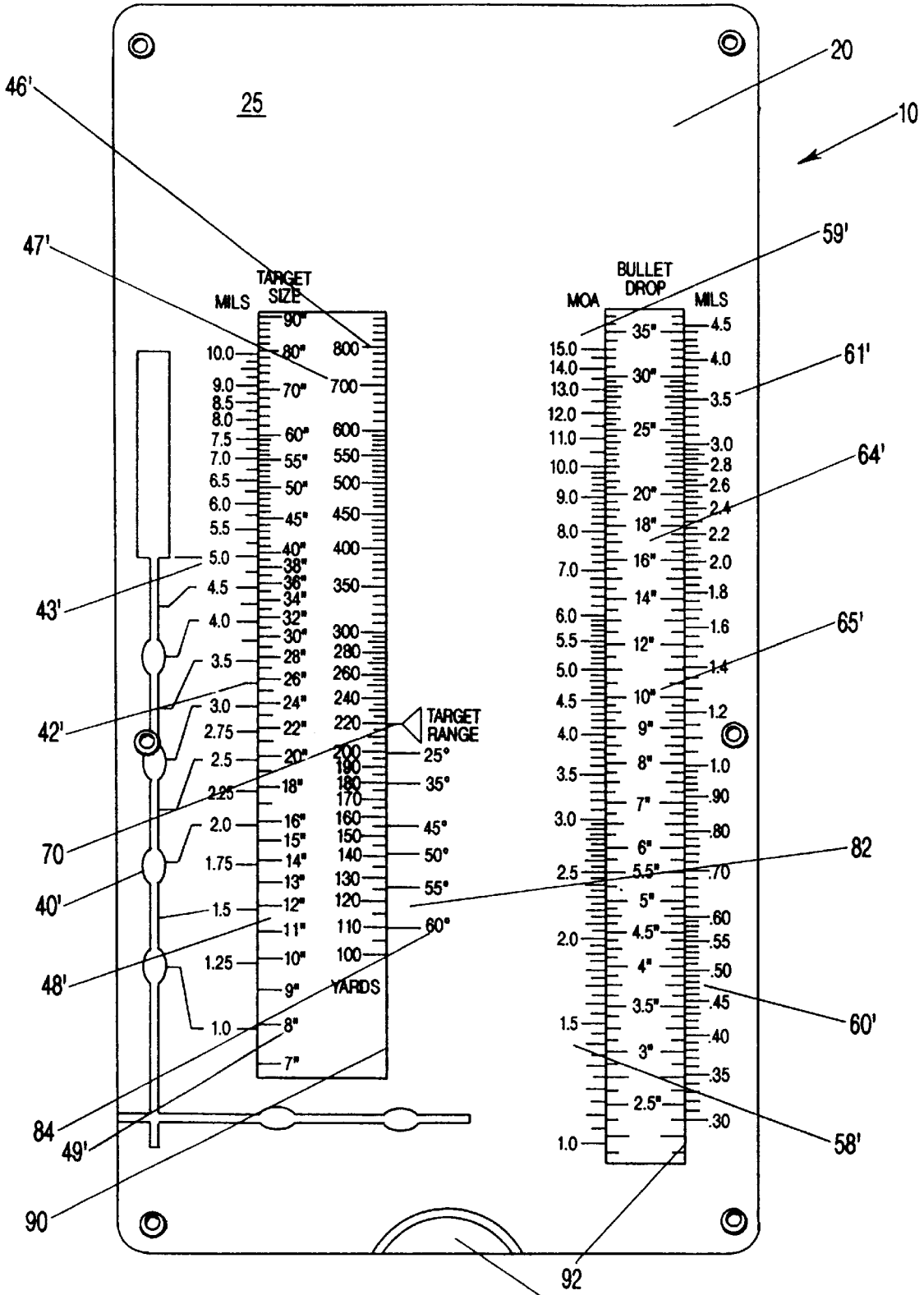
FIG. 8 is a plan view of the obverse face of the most preferred embodiment of the invention.
Figure 9:
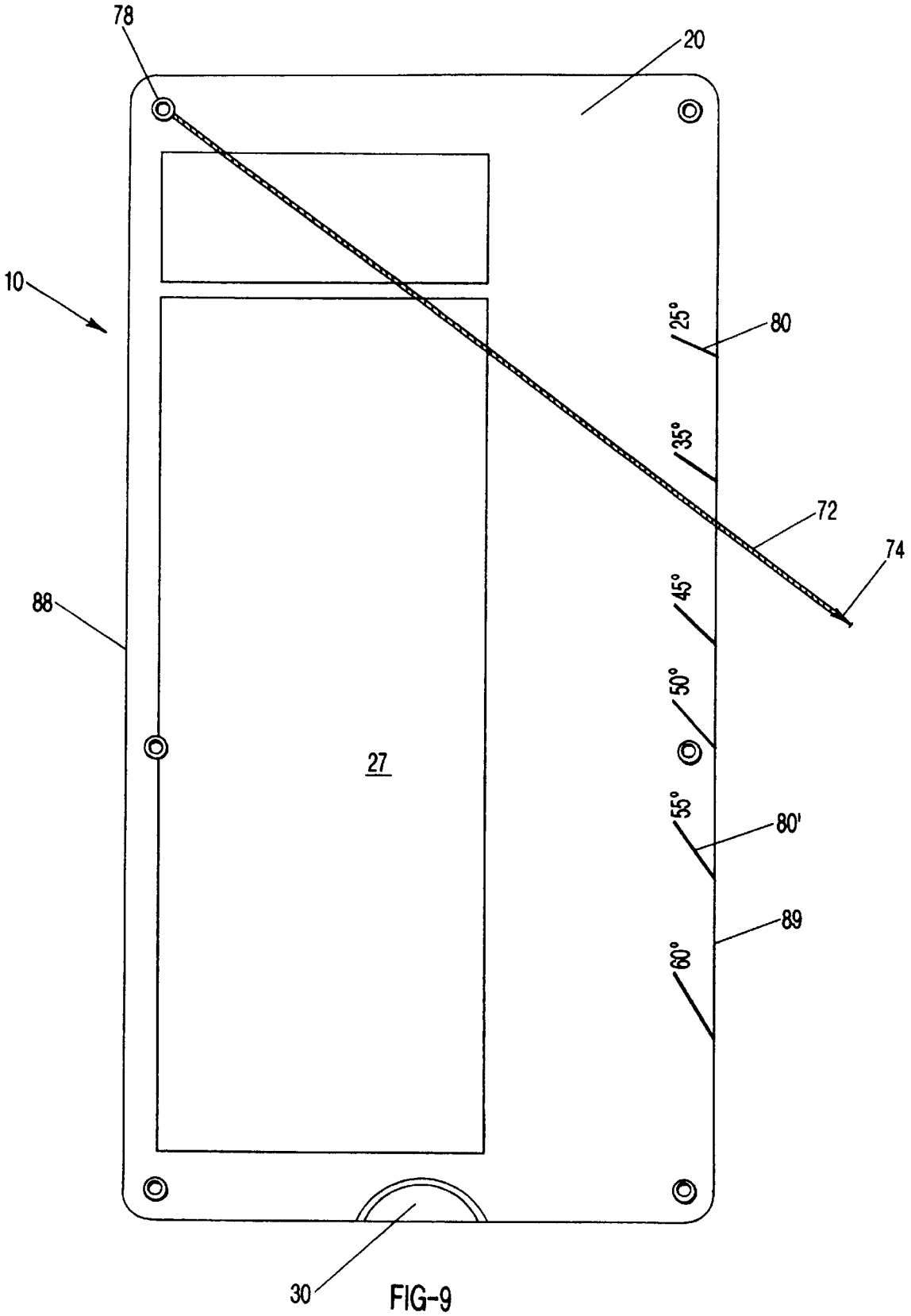
FIG. 9 is a plan view of the reverse face of the embodiment shown in FIG. 8.

Attention is invited to FIG. 8. This preferred embodiment of the apparatus 10, like previously described embodiments, features a first rule member 20 and a second rule member 30 controllably moveable adjacent to the first rule member. The first rule member 20 may be, for example, of two-ply construction whereby two sheets of plastic, cardboard, or the like, are secured in parallel contact as by comer rivets or the like, as seen in FIGS. 8 and 9. Presented on the first rule member 20 is the mildot scale 42' including a plurality of logarithmically arranged mil value marks 43'. The range scale 46', manifesting a plurality of logarithmically arranged range value markers 47', and the target dimension scale 48' having dimension value marks 49', are both disposed upon the second rule member 30 as seen in FIG. 8. An index point 70 is situated on the first rule member 20, proximate to the range scale 46'. The planar second rule member 30 is controllably movable, such as by sliding in between the two plies of the first rule member 20, to align any one dimension value mark corresponding to the known target dimension with a selected mil value mark on the mildot scale 42', thereby aligning with the index point 70 a range value mark corresponding to the actual distance to the target. Again, as previously explained, the selected mil value mark is selected based upon what the user views through the scope, i.e., the number of mils on the reticle apparently occupied by the target when viewed through the scope.

An advantage of this embodiment is its simplicity of use with a firearm having a known bullet drop or drift over a known distance, in that the calculator 10 also features an automatic means for determining an adjustment to firearm elevation or windage to compensate for bullet drop or drift. To provide for such determinations, there is at least one elevation scale 58' or 60' showing a plurality of elevation value marks 59' or 61', on the first rule member 20, and a bullet drop scale 64', made up of drop value marks 65', on the second rule member 30 proximate to one or both elevation scales 58' and 60'. Due to the relative positions of the scales 46', 48', and 64' on the one side of the rule member 30, the controlled movement of the dimension scale 48' correspondingly moves the bullet drop scale 64'. Thus, when the second rule member 30 is moved by the user to align the dimension value mark corresponding to the known target dimension with a selected mil value mark on the mildot scale 42', a single drop value mark (e.g., 65') corresponding to the known bullet drop for the firearm and cartridge in use is concurrently and automatically aligned with an elevation value mark, e.g. 59' or 61', corresponding to the necessary and appropriate adjustment to firearm elevation or windage.

As seen in FIG. 8, the first rule member 20 preferably but not necessarily defines a first rectangular aperture 90 and a second rectangular aperture 92, such as in the top ply of the member's 20 two-ply construction. As indicated by the directional arrow in FIG. 8, the second rule member 30 is controllably movable parallel to the first rule member 20, as by sliding to-and-fro between the plies of the first rule member 20. According to the configuration shown, therefore, the target dimension scale 48', the range scale 46', and the bullet drop scale 64' are arranged on the second rule member 30 so that scales 48' and 46' are generally coordinated with the first rectangular window aperture 90 and the bullet drop scale 64 is coordinated with the second rectangular window or aperture 92 respectively, so that the target dimension scale and the range scale are at least partially visible through the first aperture, and the drop scale is at least partially visible through the second aperture. As also is plainly apparent by reference to FIG. 8, the calculator 10 of this embodiment has an obverse face 25. The mildot scale 42', the range scale 46', the index point 50, the target dimension scale 48', the elevation scales 58' and 60, and the bullet drop scale 64 are disposed upon the obverse face to be collectively visible at one time. As previously described in reference to the other embodiments of the invention, the elevation scales may be either or both a minute-of-angle elevation adjustment scale 58' and a mil elevation adjustment scale 60'.

Reference is made to FIG. 9, showing the reverse face 27 of the calculator 10, and illustrating means for determining, when there is a vertical angle between the calculator 10 and the target, the horizontal distance to the target. This feature of the invention has components for measuring the vertical angle between the apparatus and the target. These components include a linear sight on one of the rule members (preferably the first rule member). The linear sight preferably is an edge 88 of the apparatus 10, but alternatively may simply be a straight line printed or engraved on one of the faces 25 or 27 of the apparatus. The linear sight is simply but properly characterized as any suitable marking or element(s) on or of the apparatus that permits the apparatus to be aimed at the target by allineating the sight between the user's eye and the target, in a manner similar to the aiming of a firearm.

Additionally, a plurality of labeled angle marks 80, 80' are disposed on the apparatus, preferably the first rule member 20. The angle marks 80, 80' are disposed along a line, such as the opposite edge 89 of the member 20, substantially parallel to the linear sight 88, while the actual line indicia of the marks 80, 80' themselves are arranged radially with respect to the pivotal attachment point 78 of the plumb 72—similarly to the arrangement of the angle indicia on a typical protractor. A plumb bob, for example a plumb consisting of a very thin shaft, or a light string 72 and a weight 74, is pivotally attached to the first rule member and is alignable by gravity with any one of the angle marks 80 or 80'. As seen in FIG. 9, the proximate end of the string 72 is attached to the first rule member 20 as by a rivet 78 or the like. The plumb bob component may be removable to be stowed when not in use. The plumb 72 is free to swing, due to the weight 74, so as to always be disposed substantially vertical with respect to the ground.

Accordingly, when the linear sight 88 is aimed at the target, the plumb 72 registers with any one of the plurality of angle marks, e.g., 80 or 80', to indicate the vertical angle between the apparatus and the target. The linear sight 88 is "aimed" by the user's placing it collinear with the imaginary line connecting the user's eye with the target; it can be aimed either "up" or "down" by simply looking either one way or the other along the linear sight 88, and instructional arrows may be provided on the apparatus for the user's reference in this regard. With the linear sight 88 thus tipped, while aimed, at an angle from vertical, the plumb 72 automatically swings by gravity to indicate the size of the vertical angle by reference to the labels on the angle marks 80,80'.

To further assist the user in determining the horizontal distance to target, the calculator 10 also includes an angle adjustment scale 82, having a plurality of labeled angle value marks 84, on the first rule member 20 adjacent to the range scale 46'. After the user has moved the second rule member 30 to align the known target dimension value mark with the selected mil value mark, thereby to align with the index pont 70 the particular range value mark corresponding to the actual distance to target, and also after having utilized the sight 88, the plumb 72, and the angle marks 80, 80' to ascertain the vertical angle between the apparatus 10 and the target, the user may the refer directly to the angle adjustment scale 82 to obtain a reading of the horizontal distance to target. Without further manipulation by the user, the particular angle value mark 84 corresponding to the vertical angle (as measured by the plumb 72 and angle marks 80, 80') directly registers with a range value mark on the range scale 46' corresponding to the horizontal distance to the target. For example, as seen in FIG. 8, the distance to target (actual) is shown to be about 220 yards, as that is the labeled range value mark aligned with the index point 70. If the use of the vertical angle indicator components (as illustrated in FIG. 9) then shows that there is a vertical angle of about 40 degrees between the user and the target, reference to the angle adjustment scale 82 (FIG. 8), with interpolation between the angle value marks labeled 35° and 45°, indicates that the horizontal distance to target is about 167 yards. If, for the same distance-to-target determination of 220 yards, the vertical angle between user and target were determined to be 60 degrees, it is seen that the angle value mark 84 corresponding to the 60-degree measurement is aligned with the range value mark labeled "110 yards", indicating that the horizontal distance to target is one-half the actual distance-to-target of 220 yards. (The foregoing is indicative of the known trigonometric principles underlying the configuration of the angle adjustment scale 82, since the cosine of 60 degrees is 0.5.) This embodiment thus eliminates the need otherwise to use cosine factors to calculate (as with a hand-held electronic calculator) the horizontal distance from the actual distance to target.

Figure 10:
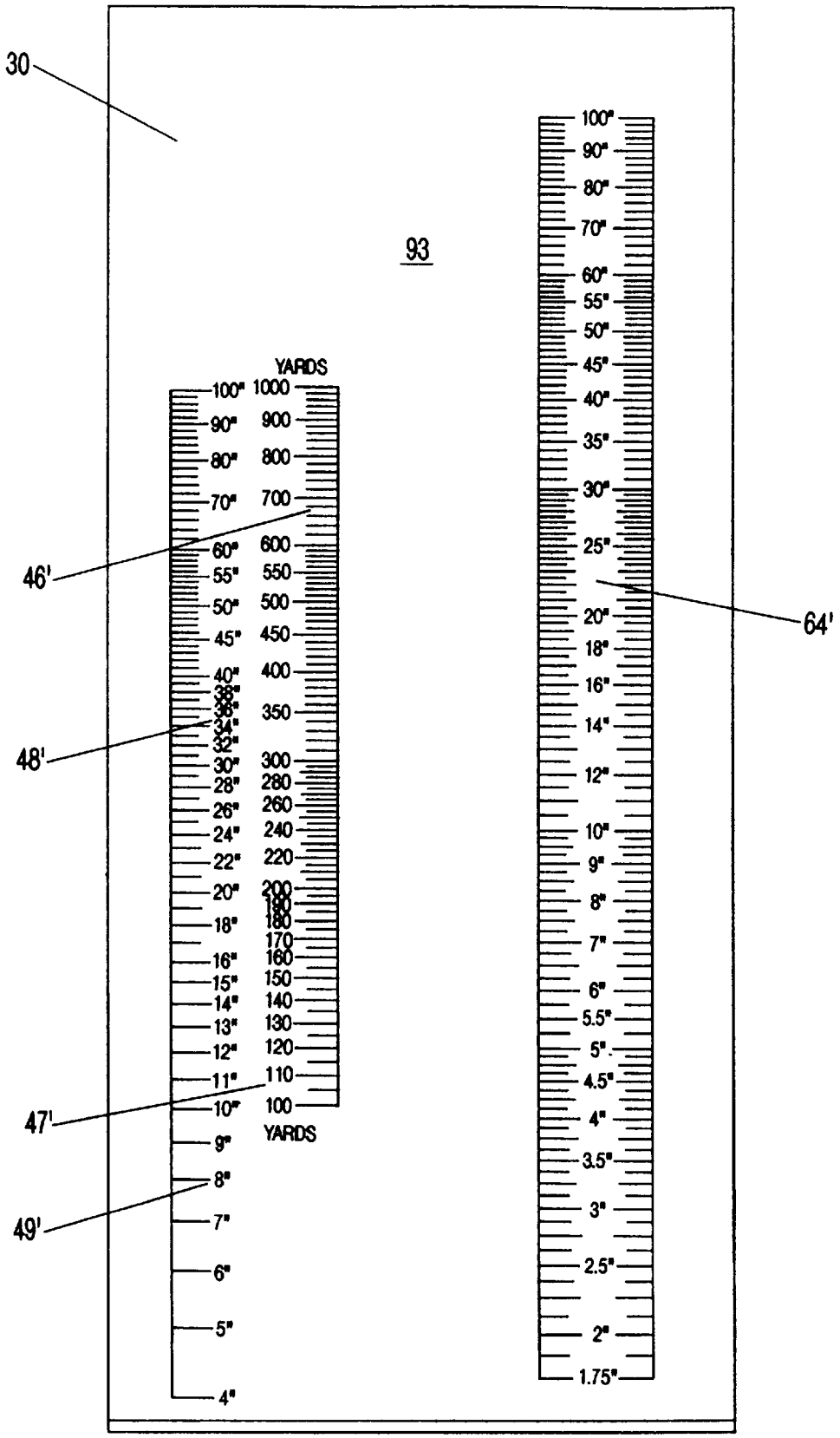
FIG. 10 is a plan view of one side of the second rule member of the embodiment shown in FIG. 8, showing the scale increments labeled in the English system of measurement.
Figure 11:
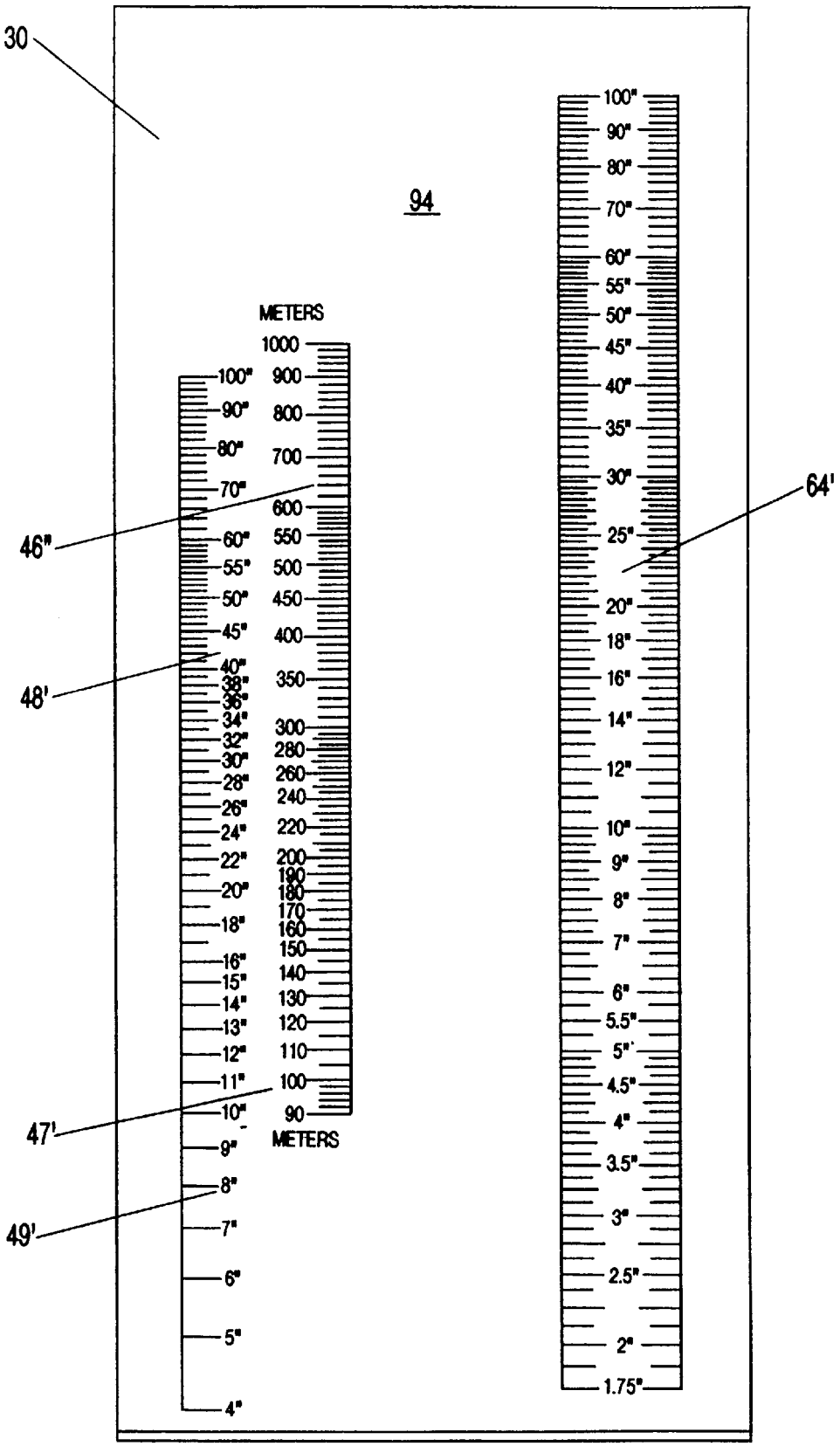
FIG. 11 is a plan view of a reverse side of the second rule member of the embodiment shown in FIG. 10, showing the target dimension and bullet drop scale increments labeled in the English system of measurements, and the range scale labeled in the metric system of measurement.

FIGS. 10 and 11 show the obverse and reverse sides, 93 and 94, respectively, of the second rule member 30 removed from contact with the first rule member. The second rule member 30 optionally is two-faced to provide for a distance-to-target calculation in meters, which is preferred in certain contexts. Reference to FIGS. 8 and 10 shows that the range value marks 47' are labeled in yards, and the dimension value marks 49' and the drop value marks 64' are labeled in increments of inches; on the English-system obverse first side 93 of the second rule member 30. The second or reverse side 94 has a metric range scale 46" with range value marks 47' labeled in meters, while the dimension scale 48' has dimension value marks 49' labeled in increments of inches, and the bullet drop scale 64' has drop value marks also labeled in inches. The mildot scale 42' and elevation scales 58', 60' are essentially dimensionless and remain unchanged upon the face of the first rule member 20. Thus, the second rule member 30 is positionable relative to the first rule member 20 to dispose the metric range scale 46" proximate to the index point 70 by merely removing the second rule member from contact with the first rule member, "flipping" or turning the second rule member over to place the reverse or second side 94 upwards, and re-inserting the second rule member 30 into the first rule member 20. The apparatus 10 thereby can be used with the first side 93 visible to perform all calculations in the English system of units, for example in most civilian applications. By using the second face 94 of the second member 30 instead, range calculations can be done in meters instead of yards, while still utilizing target dimensions and bullet drop values measured in inches, a practice occasionally encountered in police and military situations. Advantageously, this flexibility is provided using a single second rule member 30. The mildot scale 42', the index point 50, and the elevation scales 58' and 60 on the first rule 20 are unchanged, and used in the same manner irrespective of whether determinations are done in metric or English systems. The method of practicing the second side 94 embodiment of the invention is essentially unchanged, except that the range-to-target is read in meters. Alternatively, of course, the invention may be practiced with two separate but physically interchangeable second rule members 30, one having the range scale labeled in the metric system, and the other having the range scale values given in units of yards.

The method of practicing this embodiment of the invention is apparent, from the foregoing, to one of ordinary skill in the art but is nevertheless summarized. The method is useable with a firearm having a telescopic sight including a mildot reticle and having a known bullet drop or drift value over a known distance, for determining the range to a target of a known dimension and for determining an adjustment to firearm elevation or windage to compensate for bullet drop or drift. To practice the method, the user views the target through the scope to observe the number of mildots apparently occupied by the target. From the observation, the viewer is able to determine or select the appropriate a mildot value to refer to on the mildot scale 42 of the apparatus. The actual size of the target is then estimated to determine the proper target dimension value to be referred to on the target dimension scale 48'. The adjacent mildot and target dimension scales 42' and 48' are manipulated to align respective marks thereon corresponding to the selected mildot value and the known target dimension value, permitting the user to view the alignment of the index point 70 with the range value mark on the range-to-target scale 46'; the range value mark 47' aligned with the index point 70 corresponds to the actual magnitude of the distance to the target. An advantage of the method is that the step of manipulating adjacent mildot and target dimension scales also automatically, simultaneously, manipulates the bullet drop scale 64' to align the appropriate bullet drop value mark with an elevation value mark, on an elevation scale 58' and/or 60', corresponding to the actual adjustment to firearm elevation or windage necessary to correct for bullet drop or wind drift.

The continuing practice of the invention further involves the step of determining, when there is a vertical angle between the apparatus (thus also the user) and the target, the horizontal distance to the target. This step of determining horizontal distance includes measuring the vertical angle between the apparatus and the target, and viewing the alignment of an angle value mark, e.g., 80 corresponding to the vertical angle with a range value mark, e.g., 47' on a range-to-target scale. To measure the vertical angle between the apparatus and the target, the user aims a linear sight 88 at the target, permitting a plumb 72 connected to the linear sight to pivot by gravity into registration with one of a plurality of angle marks 80, 80' indicating the vertical angle between the apparatus and the target. Because manipulating the adjacent mildot and target dimension scales 42', 48' simultaneously moves a range value mark corresponding to the horizontal distance into alignment with an angle value mark, e.g., 84, corresponding to the vertical angle indicated by the one, e.g., 80, of a plurality of angle marks, the range value mark aligned with the corresponding angle adjustment mark provides the value of the horizontal distance to the target. The user then is able to determine the necessary adjustment, if to firearm elevation by controllably moving the second rule member 30 to place the range value mark corresponding to the horizontal range into alignment with the index point 70. The proper elevation adjustment, corrected to account for the vertical angle to the target, is then read from the elevation scale 58' or 60' as previously described.

It is noted that while the invention is disclosed as having the target dimension, range, and bullet drop scales on the second rule member 30 and the index point and mildot and elevation scales on the first rule member 20, it is apparent to one of ordinary skill in the art that some pairs of associated scales can be transposed from one rule member to the other. For example, alternative working embodiments may place the range scale on the first rule member 20 with the index point 70 movably adjacent thereto upon the second rule member 30. The elevation scale(s) and bullet drop scale, and/or the mildot scale and the target dimension scale, likewise may be switched between the respective rule members without departing from the spirit of the invention, and it is intended to cover in the appended claims such equivalent embodiments.

Figure 12:
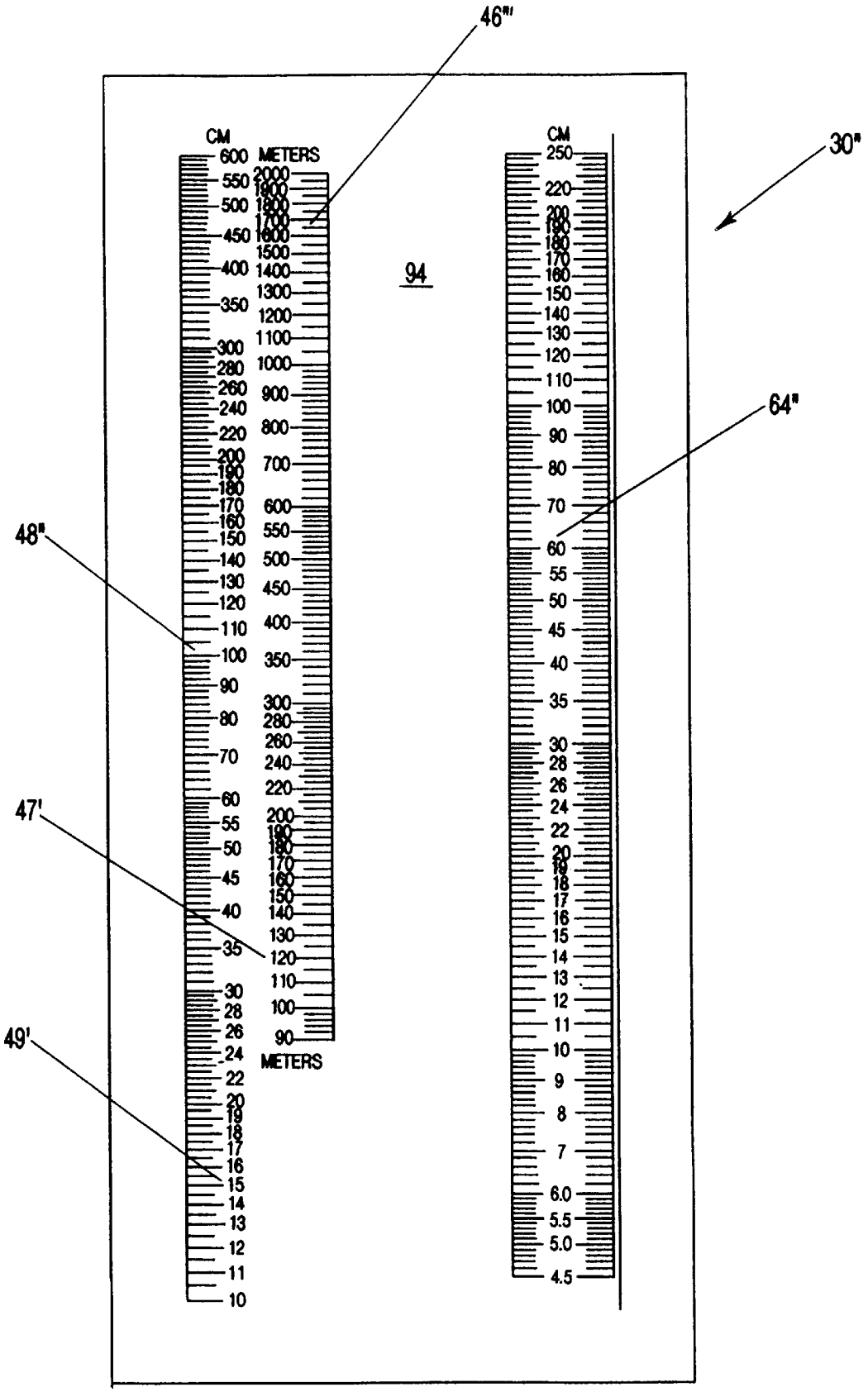
FIG. 12 is a plan view of one side of an alternative second rule member, showing the all scale increments labeled in the metric system of measurement.

FIG. 12 illustrates that the invention optionally includes a wholly metric second rule member 30", which is physically interchangeable with the preferred configuration of the second rule member 30 depicted in FIGS. 10 and 11. This wholly metric version may be the sole version of choice used in, for example, European nations where the English system of measurements is virtually unused. This wholly metric version of the member 30" has scales on one side only, and all the scales are in the metric system of units. The range scale 46'" is demarked in meters, while the metric bullet drop scale 64", and the metric target dimension scale 48" have drop and dimension values labeled in centimeters. The method and procedure for practicing the wholly metric embodiment of the invention again is the same as previously described, since the mildot scale 42, index point 70, and elevation scales 58' and 60' on the first rule member are dimensionless and can be used in conjunction with the wholly metric second rule member 30". Accordingly, the complete apparatus 10 may be adapted for use either in the English system of measurements or the metric system, by the interchangeability of a wholly metric rule member 30" with the English second rule member 30. Either is insertable and removable into the first rule member 20.

Inspection of the range scale 46'" depicted in FIG. 12 reveals that the scale is extended in scope to provide for range calculations up to 2000 meters. Notably, the logarithmic range scales 46', 46" on the fundamentally English second rule member 30 of FIGS. 10 and 11 can be similarly extended to 2000 yards or meters to maximize the versatility of the invention.

While the preferred embodiment of calculator 10 is here characterized as generally rectangular with the two rule members 20, 30 capable of reciprocating, mutually parallel longitudinal movement, a person of skill in the art will immediately appreciate that the calculator 10 may be otherwise shaped without departing from the scope and spirit of the invention. The only practical limitation confining the design of the apparatus of the invention is that the rangefinder scales are maintained in parallel relation to each other throughout their range of selected movement, and likewise that the elevation adjustment scales remain in mutually parallel relation. Consequently, alternative embodiments of the inventive calculator 10 potentially may take the shape, for example, of a circular disc, rotatably mounted within a circular frame, the disc and the frame having circumferential and/or circular scales or window apertures which can be selectively aligned radially. The disc is concentrically sandwiched within the circular frame, and the two elements are joined by a common central pivot. The user rotates the central disc to register, for example, an index on the disc with a window in the frame, permitting a determined value to be read by noting where a certain mark on the disc perimeter aligns with another mark on a circular scale on the frame.

Because the calculator 10 can be used easily to convert a bullet drop figure into a telescopic sight adjustment figure, independently from the calculation of range to target, the inventive apparatus may be used with non-mildot-type scopes. For example, it is apparent that the elevation adjustment aspect of the invention may be used in operative combination with optical or laser rangefinders.

A number of advantages of the invention are thus apparent. Since the target dimension scale preferably is in increments of inches, no conversion of estimated target size from inches into decimal equivalent of yards is necessary. No entry of data or operations through a keypad is needed, as the apparatus is truly analog and only requires the alignment of indices and scales. The user need not memorize any formulae, as the correct formulae are "built into" the scales. The user is freed from having to perform complex calculations for determination of telescopic sight adjustment or holdover at various ranges, because the reverse side of the apparatus converts drop/drift figures directly into both minute-of-angle and mils. The speed of the calculations necessary to determine range to target and required telescopic sight adjustment and/or hold-over is significantly reduced by employing the invention in lieu of a hand-held electronic calculator. The apparatus is includes only two main parts, utilizes no electrical or electronic parts, and requires no batteries; its simplicity of construction and operation results in extreme reliability under adverse conditions.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents.

What is claimed is:

1. An apparatus, useable with a telescopic sight having a mildot reticle, for determining the distance to a target of a known dimension, the apparatus comprising:

a first rule member;

a second rule member controllably moveable adjacent to said first rule member;

a mildot scale, comprising mil value marks, on said first rule member;

a range scale, comprising range value marks, on said second rule member;

an index point on said first rule member proximate to said range scale;

a target dimension scale, comprising dimension value marks, on said second rule member; and said second rule member controllably movable to align a dimension value mark corresponding to the known dimension with a selected mil value mark on said mildot scale, thereby aligning with said index point a range value mark corresponding to the distance to the target.

2. An apparatus according to claim 1, useable with a firearm having a known bullet drop or drift over a known distance, further comprising means for determining an adjustment to firearm elevation or windage to compensate for bullet drop or drift, said means for determining adjustment comprising:

at least one elevation scale, comprising elevation value marks, on said first rule member; and a bullet drop scale, comprising drop value marks, on said second rule member proximate to said at least one elevation scale; wherein when said second rule member is controllably moved to align said dimension value mark corresponding to the known dimension with a selected mil value mark on said mildot scale, a drop value mark corresponding to the known bullet drop is concurrently aligned with an elevation value mark, corresponding to the adjustment to firearm elevation or windage, on said at least one elevation scale.

3. An apparatus according to claim 2 wherein said first rule member defines a first rectangular aperture and a second rectangular aperture.

4. An apparatus according to claim 3 wherein said second rule member is controllably movable parallel to said first rule member.

5. An apparatus according to claim 3 wherein said target dimension scale and said range scale are at least partially visible through said first aperture.

6. An apparatus according to claim 5 wherein said bullet drop scale is at least partially visible through said second aperture.

7. An apparatus according to claim 4 wherein said apparatus comprises an obverse face, and said mildot scale, said range scale, said index point, said target dimension scale, said at least one elevation scale, and said bullet drop scale are disposed upon said obverse face.

8. An apparatus according to claim 2 wherein said at least one elevation scale comprises a minute-of-angle elevation adjustment scale and a mil elevation adjustment scale.

9. An apparatus according to claim 2 further comprising means for determining, when there is a vertical angle between said apparatus and the target, the horizontal distance to the target.

10. An apparatus according to claim 9 wherein said means for determining the horizontal distance comprises means for measuring the vertical angle between said apparatus and the target, said means for measuring comprising:

a linear sight on one of said rule members;

a plurality of angle marks on said first rule member; and a plumb pivotally attached to said first rule member and alignable by gravity with any one of said angle marks;

wherein when said linear sight is aimed at the target, said plumb registers with one of said plurality of angle marks to indicate the vertical angle between the apparatus and the target.

11. An apparatus according to claim 10 further comprising an angle adjustment scale, comprising angle value marks, on said first rule member adjacent to said range scale, wherein an angle value mark corresponding to the vertical angle registers with a range value mark corresponding to the horizontal distance to the target.

12. An apparatus according to claim 2 wherein said range value marks, said dimension value marks, and said drop value marks are labeled in increments of inches or yards on a first side of said second rule member, and further comprising a second range scale, a second target dimension scale, and a second bullet drop scale on a second side of said second rule member, said second range scale having range value marks labeled in metric increments, and said second target dimension scale and said second bullet drop scale having dimension value marks and drop value marks, respectively, labeled in increments of inches or yards, wherein said second rule member is positionable relative to said first rule member to dispose said second range scale proximate to said index point and said second bullet drop scale proximate to said at least one elevation scale.

13. An apparatus according to claim 12, additionally comprising a separate wholly metric second rule member, interchangeable with said second rule member, said wholly metric second rule member having all said value marks labeled in metric increments.

14. An apparatus, useable with a telescopic sight having a mildot reticle, for determining the distance to a target of a known dimension, the apparatus comprising:

a first rule member;

a second rule member controllably moveable adjacent to said first rule member;

a mildot scale, comprising mil value marks, on said first rule member;

a range scale, comprising range value marks, on said first rule member;

an index point on said second rule member proximate to said range scale;

a target dimension scale, comprising dimension value marks, on said second rule member adjacent to said mildot scale; and said second rule member controllably movable to align a dimension value mark corresponding to the known dimension with a selected mil value mark on said mildot scale, thereby aligning said index point with a range value mark corresponding to the distance to the target.

15. An apparatus according to claim 14, useable with a firearm having a known bullet drop or drift over a known distance, further comprising means for determining an adjustment to firearm elevation or windage to compensate for bullet drop or drift, said means for determining adjustment comprising:

at least one elevation scale, comprising elevation value marks, on said first rule member;

a bullet drop scale, comprising drop value marks, on said second rule member proximate to said at least one elevation scale; and wherein when said second rule member is controllably moved to align said dimension value mark corresponding to the known dimension with a selected mil value mark on said mildot scale, a drop value mark corresponding to the known bullet drop is automatically concurrently aligned with an elevation value mark corresponding to the adjustment to firearm elevation or windage.

16. An apparatus according to claim 15 wherein said first rule member is generally rectangular and defines a first rectangular aperture and a second rectangular aperture.

17. An apparatus according to claim 16 wherein said second rule member is generally rectangular and controllably movable parallel to said first rule member.

18. An apparatus according to claim 17 wherein said target dimension scale and said range scale are substantially mutually parallel and at least partially visible through said first aperture.

19. An apparatus according to claim 18 wherein said bullet drop scale is generally parallel to said at least one elevation scale and is at least partially visible through said second aperture.

20. An apparatus according to claim 17 wherein said apparatus comprises an obverse face, and said mildot scale, said range scale, said index point, said target dimension scale, said at least one elevation scale, and said bullet drop scale are disposed upon said obverse face.

21. An apparatus according to claim 14 further comprising means for determining, when there is a vertical angle between said apparatus and the target, the horizontal distance to the target.

22. An apparatus according to claim 21 wherein said means for determining the horizontal distance comprises means for measuring the vertical angle between said apparatus and the target, said means for measuring comprising:

a linear sight on one of said rule members;

a plurality of angle marks on said first rule member; and a plumb pivotally attached to said first rule member and alignable by gravity with any one of said angle marks;

wherein when said linear sight is aimed at the target, said plumb registers with one of said plurality of angle marks to indicate the vertical angle between the apparatus and the target.

23. An apparatus according to claim 22 further comprising an angle adjustment scale, comprising angle value marks, on said first rule member adjacent to said range scale, wherein an angle value mark corresponding to the vertical angle registers with a range value mark corresponding to the horizontal distance to the target.

24. An apparatus, useable with a firearm having a telescopic sight including a mildot reticle and having a known bullet drop or drift over a known distance, for determining the distance to a target of a known dimension and for determining an adjustment to firearm elevation or windage to compensate for bullet drop or drift, said apparatus comprising:

a first rule member;

a second rule member controllably moveable adjacent to said first rule member;

a mildot scale, comprising mil value marks, on said first rule member;

a range scale, comprising range value marks, on said second rule member;

an index point on said first rule member proximate to said range scale;

a target dimension scale, comprising dimension value marks, on said second rule member, said dimension value marks alignable with said mil value marks;

at least one elevation scale, comprising elevation value marks, on said first rule member;

a bullet drop scale, comprising drop value marks, on said second rule member; said bullet drop value marks alignable with said elevation value marks;

wherein when said second rule member is controllably moved to align a dimension value mark corresponding to the known dimension with a selected mil value mark on said mildot scale, said index point is aligned with a range value mark corresponding to the distance to the target, and a drop value mark corresponding to the known bullet drop simultaneously is aligned with an elevation value mark corresponding to the adjustment to firearm elevation or windage.

25. An apparatus according to claim 24 wherein all said scales and said index point are disposed upon a single planar face of said apparatus.

26. An apparatus according to claim 25 wherein said first rule member defines a first aperture and a second aperture, said second rule member is slidably movable parallel to said first rule member, said mildot scale and said index point are disposed adjacent to said first aperture, said target dimension scale and said range scale are at least partially visible through said first aperture, said at least one elevation scale is disposed adjacent to said second aperture, and said bullet drop scale is visible through said second aperture.

27. An apparatus according to claim 25 further comprising a mildot reticle facsimile on said planar face.

28. An apparatus according to claim 24 further comprising means for determining, when there is a vertical angle between said apparatus and the target, the horizontal distance to the target.

29. An apparatus according to claim 28 wherein said means for determining the horizontal distance comprises means for measuring the vertical angle between said apparatus and the target, said means for measuring comprising:

a linear sight on one of said rule members;

a plurality of angle marks on said first rule member; and a plumb pivotally attached to said first rule member and alignable by gravity with any one of said angle marks;

wherein when said linear sight is aimed at the target, said plumb registers with one of said plurality of angle marks to indicate the vertical angle between the apparatus and the target.

30. An apparatus according to claim 29 further comprising an angle adjustment scale, comprising angle value marks, disposed on said first rule member adjacent to said range scale, wherein when said second rule member is controllably moved to align a dimension value mark corresponding to the known dimension with a selected mil value mark on said mildot scale, an angle value mark corresponding to the vertical angle registers with a range value mark corresponding to the horizontal distance to the target.

31. An apparatus according to claim 24 wherein said at least one elevation scale comprises a minute-of-angle elevation adjustment scale and a mil elevation adjustment scale.

32. An apparatus according to claim 24 wherein said range value marks, said dimension value marks, and said drop value marks are labeled in increments of inches or yards on a first side of said second rule member, and further comprising a second range scale, a second target dimension scale, and a second bullet drop scale on a second side of said second rule member, said second range scale having range value marks labeled in metric increments, and said second target dimension scale and said second bullet drop scale having dimension value marks and drop value marks, respectively, labeled in increments of inches or yards, wherein said second rule member is positionable relative to said first rule member to dispose said second range scale proximate to said index point and said second bullet drop scale proximate to said at least one elevation scale.

33. An apparatus according to claim 32, additionally comprising a separate wholly metric second rule member, interchangeable with said second rule member, said wholly metric second rule member having all said value marks labeled in metric increments.

34. A method, useable with a firearm having a telescopic sight including a mildot reticle and having a known bullet drop or drift value over a known distance, for determining the range to a target of a known dimension and for determining an adjustment to firearm elevation or windage to compensate for bullet drop or drift, the method comprising the steps of:

a) viewing the target through the scope;

b) observing the number of mildots apparently occupied by the target to determine a mildot value;

c) estimating the actual size of the target to determine a target dimension value;

d) manipulating adjacent mildot and target dimension scales to align respective marks thereon corresponding to the mildot value and the known target dimension value; and e) viewing the alignment of an index point with a range value mark on a range-to-target scale;

wherein the step of manipulating adjacent mildot and target dimension scales further comprises automatically simultaneously manipulating a bullet drop scale to align a bullet drop value mark with an elevation value mark, on an elevation scale, corresponding to the adjustment to firearm elevation or windage.

35. A method according to claim 34 further comprising determining, when there is a vertical angle between the apparatus and the target, the horizontal distance to the target, wherein the step of determining horizontal distance comprises:

(a) measuring the vertical angle between the apparatus and the target; and;

(b) viewing the alignment of an angle value mark corresponding to the vertical angle with a range value mark on the range-to-target scale.

36. A method according to claim 35 wherein the step of measuring the vertical angle between the apparatus and the target comprises:

(a) aiming a linear sight at the target;

(b) permitting a plumb connected to the linear sight to pivot by gravity into registration with one of a plurality of angle marks indicating the vertical angle between the apparatus and the target.

37. A method according to claim 36 wherein the step of manipulating adjacent mildot and target dimension scales further comprises simultaneously moving a range value mark corresponding to the horizontal distance into alignment with an angle value mark corresponding to the vertical angle indicated by the one of a plurality of angle marks.

* * * * *